US009789601B1

(12) United States Patent
Judge

(10) Patent No.: US 9,789,601 B1
(45) Date of Patent: Oct. 17, 2017

(54) WOODWORKER'S LIGHT RAIL SYSTEM

(71) Applicant: Alfred H Judge, Prescott Valley, AZ (US)

(72) Inventor: Alfred H Judge, Prescott Valley, AZ (US)

(73) Assignee: Alfred H. Judge, Prescott Valley, AZ (US)

( * ) Notice: Subject to any disclaimer, the term of this patent is extended or adjusted under 35 U.S.C. 154(b) by 0 days.

(21) Appl. No.: 15/488,496

(22) Filed: Apr. 16, 2017

Related U.S. Application Data

(60) Provisional application No. 62/391,312, filed on Apr. 27, 2016.

(51) Int. Cl.

| | |
|---|---|
| ***B25B 11/00*** | (2006.01) |
| ***B25H 1/04*** | (2006.01) |
| ***B25H 1/16*** | (2006.01) |
| ***B25H 1/10*** | (2006.01) |

(52) U.S. Cl.
CPC ..... *B25H 1/04* (2013.01); *B25H 1/10* (2013.01); *B25H 1/16* (2013.01)

(58) Field of Classification Search
CPC .. B25B 11/00; B25B 5/00; B23Q 1/03; B23Q 3/00
See application file for complete search history.

(56) References Cited

U.S. PATENT DOCUMENTS

| | | | | |
|---|---|---|---|---|
| 5,226,250 A * | 7/1993 | Ulmer | A47B 3/0818 108/132 |
| 5,950,999 A * | 9/1999 | Lin | B25H 1/14 269/139 |
| 6,113,088 A * | 9/2000 | Gakhar | B25B 5/105 269/139 |
| 8,118,292 B2 * | 2/2012 | Zhang | B25H 1/04 269/139 |

* cited by examiner

*Primary Examiner* — Lee D Wilson

(57) ABSTRACT

A modular, multi-functional, workbench is disclosed that is variable in height, width, and length in order to accommodate a wide variety of applications. The table top includes a plurality of rail pairs supported by leg stands. A rail pair is formed by two extrusions joined together by endplates that maintain a parallel orientation and prevent rotation of the rails. The extrusions are rectangular in cross-section and slotted on all four sides to allow the use of a variety of t-track fasteners. The leg stands support, constrain and locate the rail pairs along the width of the table. The rail pairs provide a table top surface that is generally flat and sturdy. The workbench can be used in an open-grid fashion or with solid top inserts. The modular nature of the workbench makes it easy to store and set up as well as highly versatile and easily transported to job sites.

20 Claims, 29 Drawing Sheets

Fig. 17
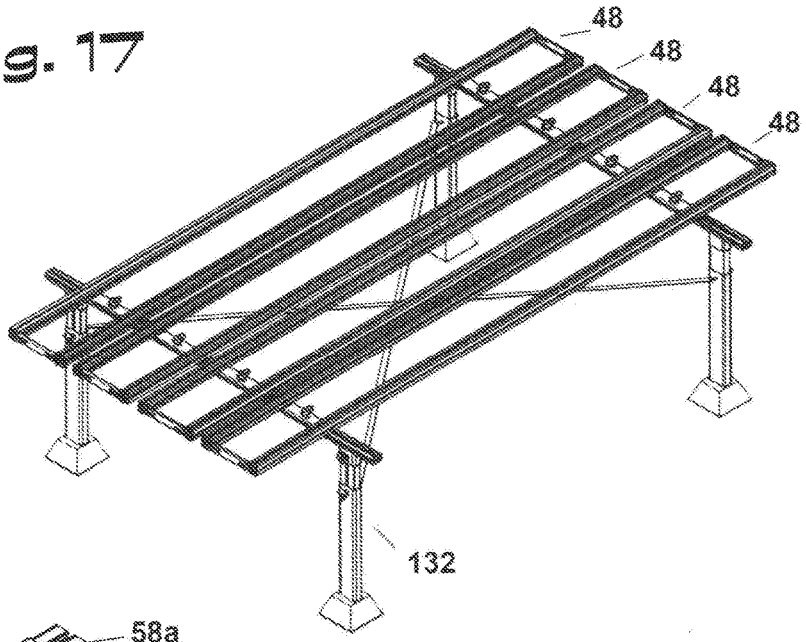
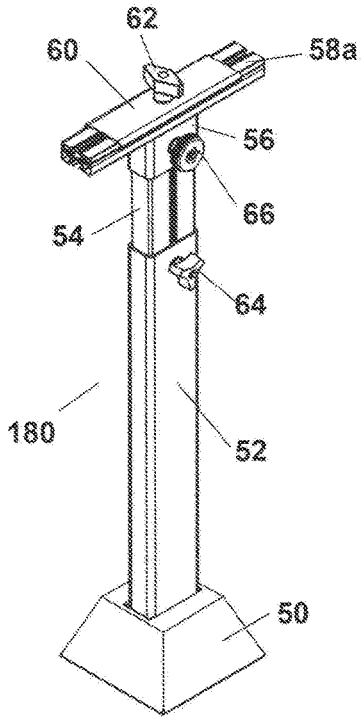
Fig. 18
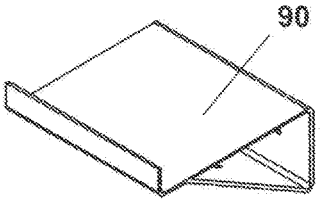
Fig. 19

Fig. 20
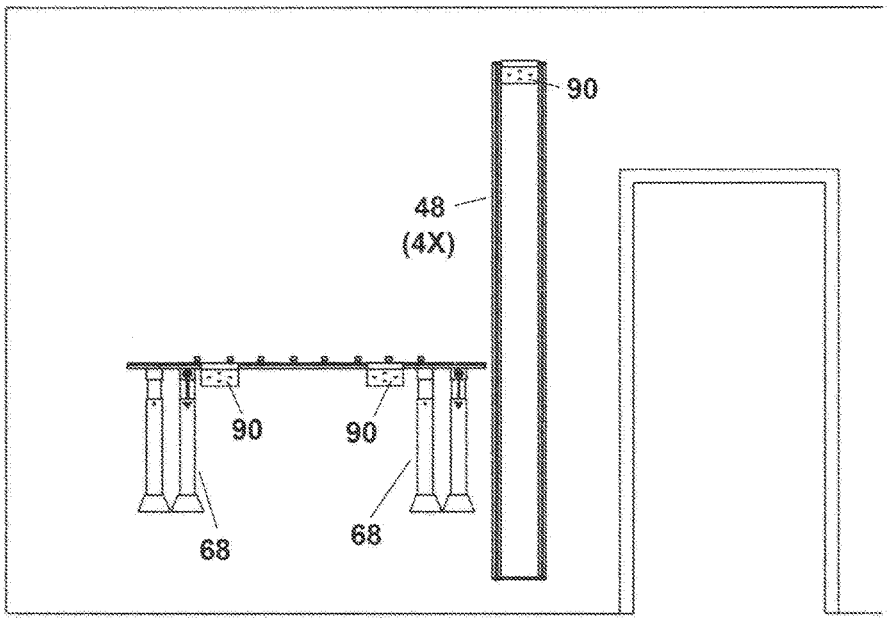
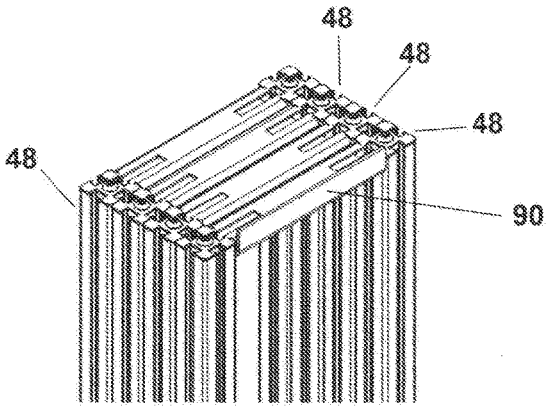
Fig. 21

Fig. 22
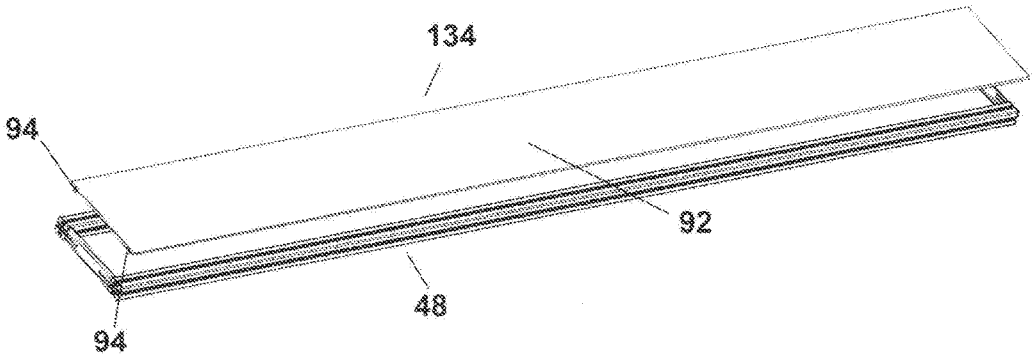
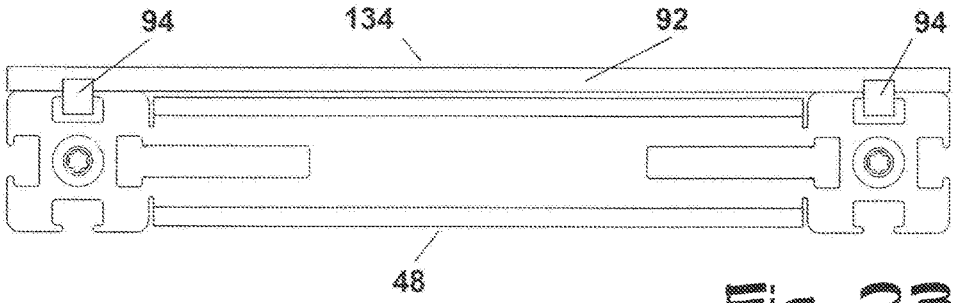
Fig. 23
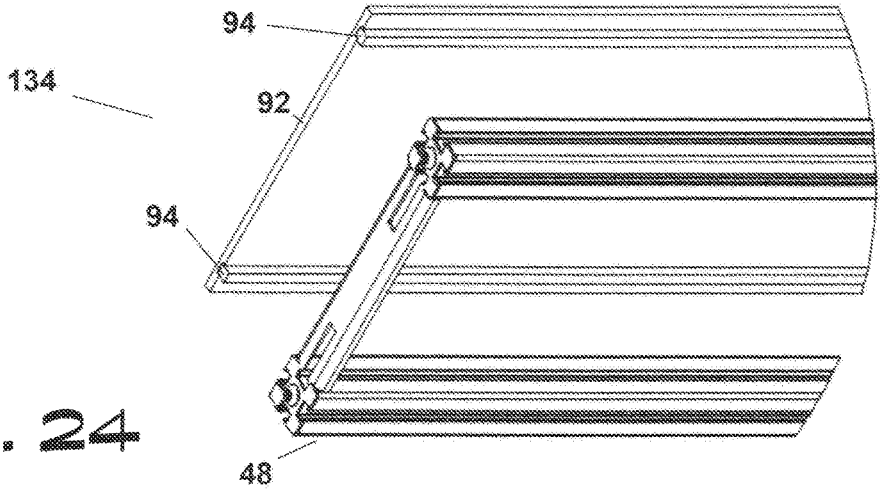
Fig. 24

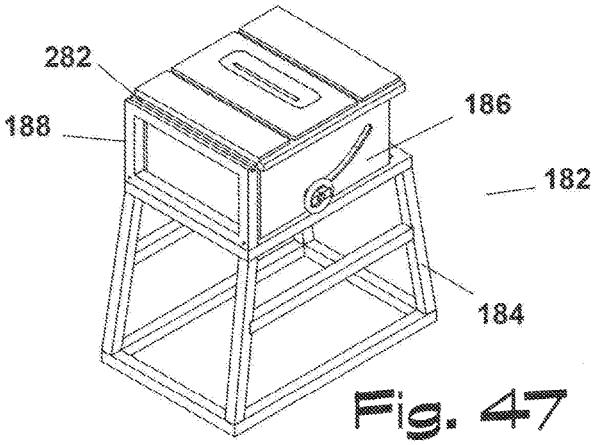
Fig. 47
Fig. 48
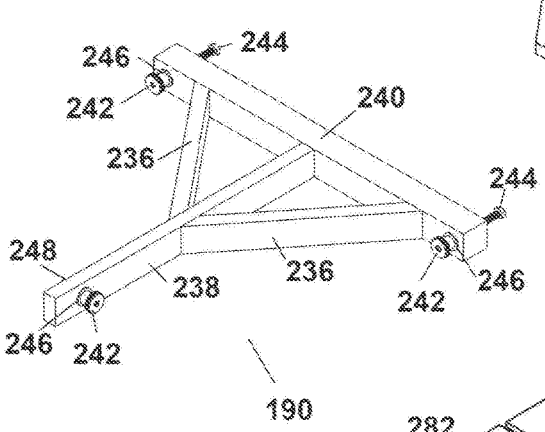
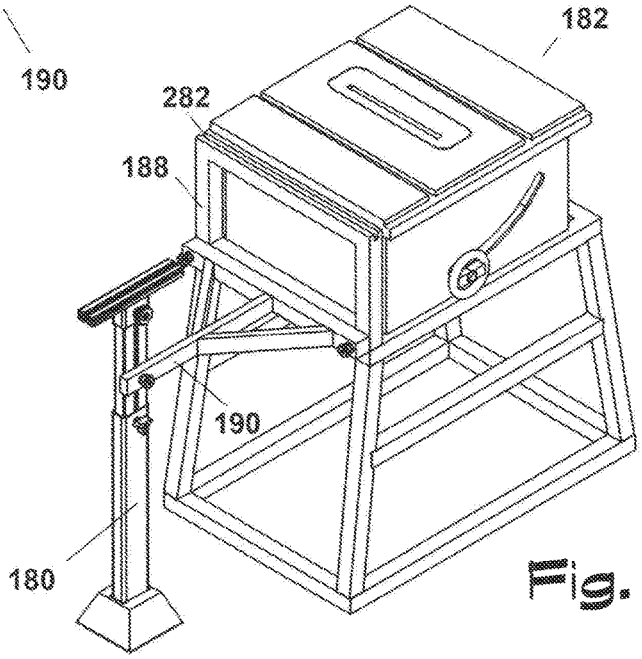
Fig. 49

Fig. 58
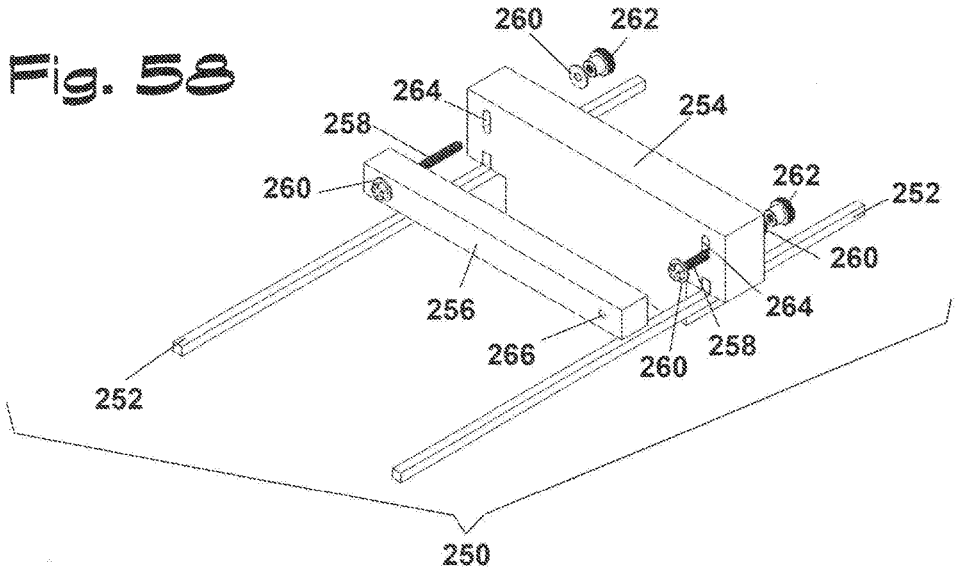
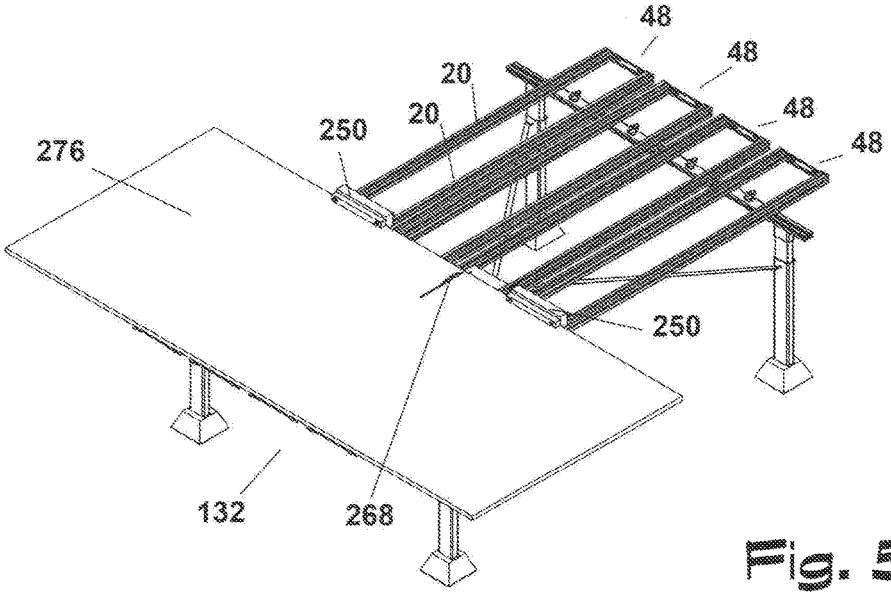
Fig. 59

WOODWORKER'S LIGHT RAIL SYSTEM

CROSS-REFERENCE TO RELATED APPLICATIONS

This application claims the benefit of U.S. Application No. 62/391,312 filed on Apr. 27, 2016.

FIELD OF THE INVENTION

The present invention relates generally to workbenches, and more particularly to modular workbenches that can be configured for a wide variety of woodworking uses.

BACKGROUND OF THE INVENTION

Assembly of large cabinets can be a difficult task for one person. It can also be a challenge to square up a large cabinet before final assembly.

Many woodworkers work in limited space in their garage or basement. Storing a large workbench or leaving it permanently in place is often a problem.

Although there are a number of aluminum extrusions with T-tracks available, they are not optimized for use with all three common T-track fasteners. They were designed to use T-Nuts. T-Bolts often bind and need to be jarred loose with a hammer. Hex-head bolts—which are 90% less costly than T-Bolts—cannot be used at all since there is no way to tighten them. Even T-Nuts can be a problem if they are used incorrectly—they will bind and have to be jarred loose.

It is difficult for one person to accurately cut large panels like 4×8 sheets of plywood. Most lumber yards have panel saws that are used for this purpose and customers often have their sheet goods cut into smaller pieces at the lumber yard. Panel saws are cost prohibitive for the average woodworker and require a significant amount of dedicated space. Panel saws cannot easily be taken to job sites.

Routing long slots accurately requires a significant amount of time, effort, and skill; and usually involves the use of a custom jig to guide and constrain the router.

Table saw slide tables greatly increase the accuracy and ease of cutting with a table saw, but they are cost prohibitive for most woodworkers. They also require a significant amount of dedicated floor space and are not easily transported to job sites.

Miter saw stands support the material being cut, but often require adjusting the workpiece supports for each cut made.

Job site table saws have relatively small table tops for supporting the material being cut. When large panels are cut a second person or an outfeed table is required to support the material after it is cut. Likewise, a second person or an infeed table is required for ripping and very large crosscuts.

It is difficult for one person to position and mount wall cabinets.

Cutting large circles, such as round table tops requires a custom set up.

Assembling picture frames, face frames, screens, and panel doors requires the use of special fixtures and clamps.

Accordingly, it is desirable to have a modular work table that can be configured for a wide variety of uses. In addition, it is desirable to have a large work table that can easily be stored on a wall or transported to a job site. Furthermore, other desirable features and characteristics of the present invention will become apparent from the subsequent detailed description of the invention and the appended claims, taken in conjunction with the accompanying drawings and the background of the invention.

BRIEF SUMMARY OF THE INVENTION

In accordance with the present invention, an improved woodworker's workbench and multi-functional tool is provided that enhances the use of many tools while allowing a single person to perform tasks that would normally require additional help. The design features also improve accuracy and speed set up. Easy storage of the components makes it an ideal product for small workshops, as well as job sites.

The workbench includes two leg stands that are adjustable in height and a plurality of rail pairs that form an open grid top work surface. This arrangement enhances versatility and portability. The leg stands include vertical scales on each leg member and a horizontal scale on each horizontal support member. The leg stands also include a number of rail pair locators on each horizontal support member. Smaller single leg stands are included for a number of special configurations. The rail pairs include T-track slots for common T-track fasteners.

The workbench system can be quickly reconfigured to simplify common woodworking tasks and challenges. Applications include cabinet assembly; a panel saw; in-feed and out-feed tables; a table saw slide-table; a miter saw stand; a large router table; a downdraft sanding table; a large circle cutter; assembly of door panels, picture frames, and screens; and routing rabbets, dados, and edges. Its use can also help a jobsite table saw perform like a contractor's table saw by providing a larger work surface and increased cutting capacity.

Additional features and benefits of the present invention are described and will be apparent from the accompanying drawings and descriptions below.

BRIEF DESCRIPTION OF THE DRAWINGS

FIG. 17 is a perspective view of the entire assembly of the basic unit setup as a work table;

FIG. 18 is a perspective view of an optional single leg stand;

FIG. 19 is a perspective view of a wall-mounted storage bracket;

FIG. 20 illustrates storage of the basic unit;

FIG. 21 is a partial perspective view of four rail pairs hanging from the storage bracket of FIG. 19;

FIG. 22 is a perspective view showing an optional solid top for a rail pair;

FIG. 23 is an end view showing the relationship of the solid top to the rail pair;

FIG. 24 is a partial perspective view of the solid top and rail pair from the bottom;

FIG. 47 is a perspective view of a table saw mounted on a stand;

FIG. 48 is a perspective view of the brace which connects the table saw stand to the slide table structure of FIG. 50;

FIG. 49 is a perspective view of the means of attaching a single leg stand to the table saw stand of FIG. 47;

FIG. 58 is a partially exploded perspective view of the cross-cut sled and clamp used with the system for cross-cutting large panels as illustrated in FIG. 59;

FIG. 59 is a perspective view of the system configuration for cross-cutting large panels.

DETAILED DESCRIPTION

The following detailed description is merely exemplary in nature and is not intended to limit the invention disclosed herein or application and uses of the invention disclosed herein. Furthermore, there is no intention to be bound by any principle or theory, whether expressed or implied, presented in the preceding technical field, background, summary or the following detailed description, unless explicitly recited as claimed subject matter.

The preferred embodiment of the invention is illustrated through the accompanying drawings. The same number refers to the same component in all illustrations.

Most components are rectangular in shape, but could be also be circular or elliptical in shape. The design and function of the concept is independent of component shape or size.

Figure 4:
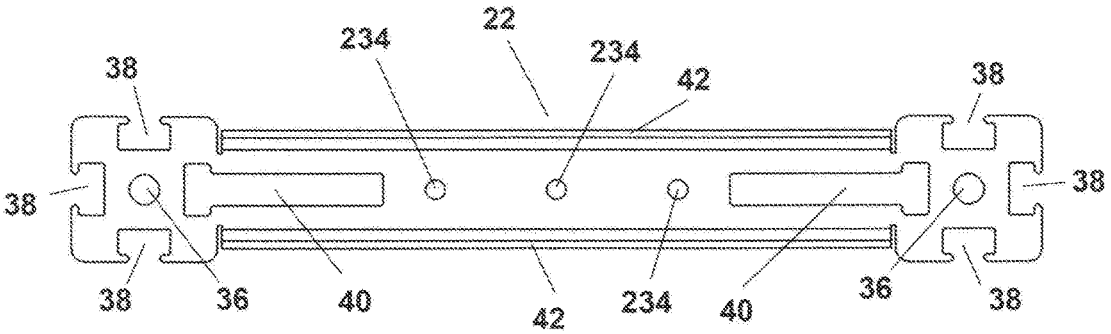
FIG. 4 is an isolated plan view of the end plates.
Figure 5:
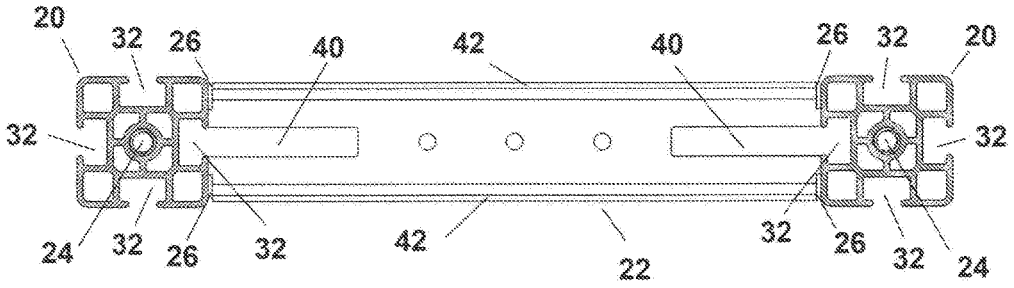
FIG. 5 is a section view illustrating the relationship of the rails and endplates.
Figure 6:
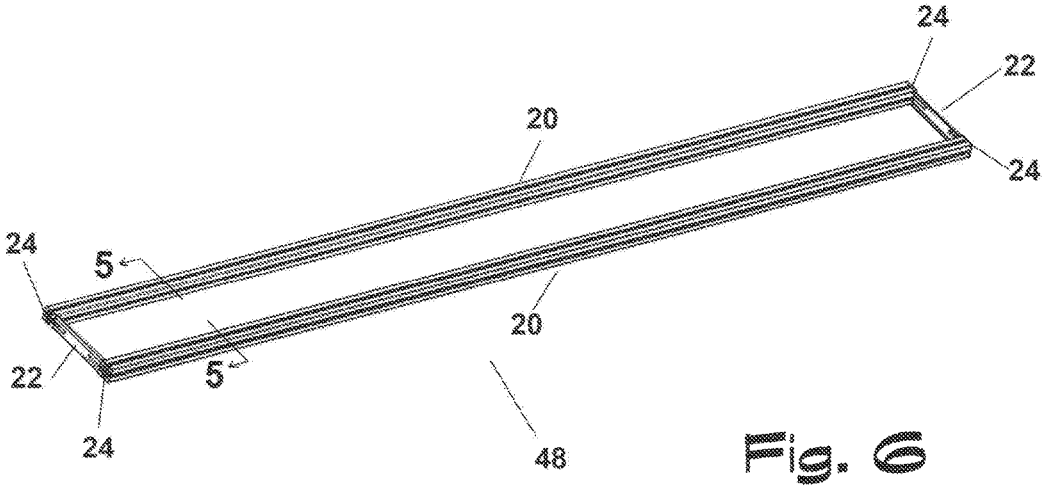
FIG. 6 is a perspective view illustrating the proportions and composition of the rail pairs as well as the location of Section 5 5.

FIGS. 1 through 6 illustrate the Rail Pairs 48 that are used to create the top work surface of the workbench and other applications of the concept. The preferred embodiment uses two rails 20 joined together by two end plates 22 and secured by four bolts 24 as illustrated in FIG. 6. Although three or more rails joined together could perform the same work surface function, their versatility and utility would be hampered as compared to just two rails.

Figure 1:
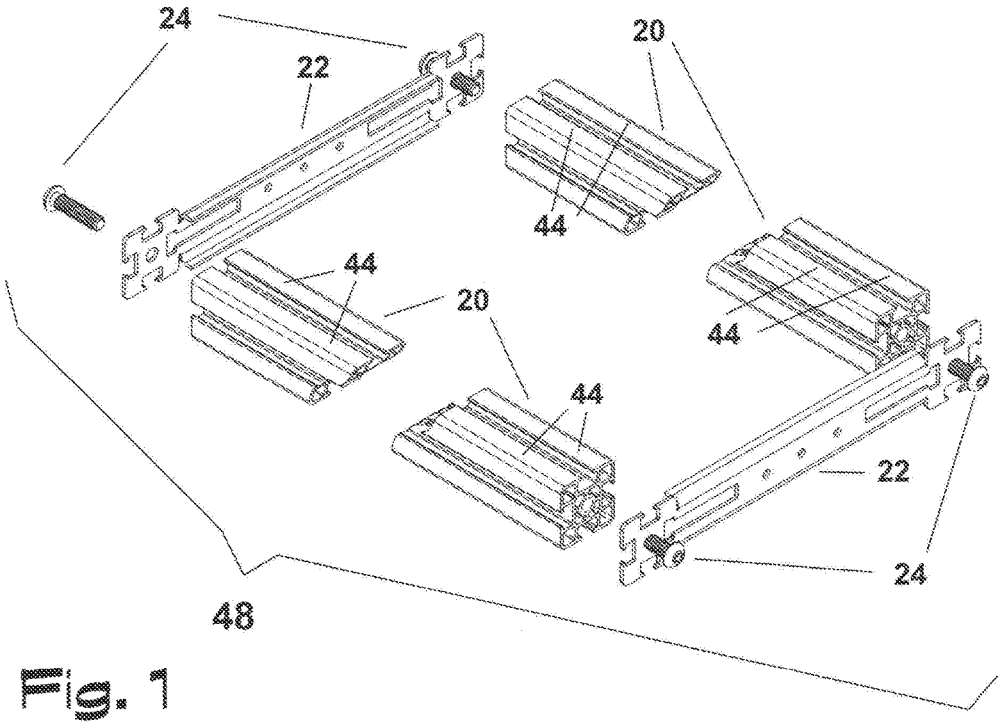
FIG. 1 is an exploded view of the ends of the rail pair illustrated in FIG. 6.

A closer view of the assembly ends of the rail pairs 48 is shown in FIG. 1.

Figure 2:
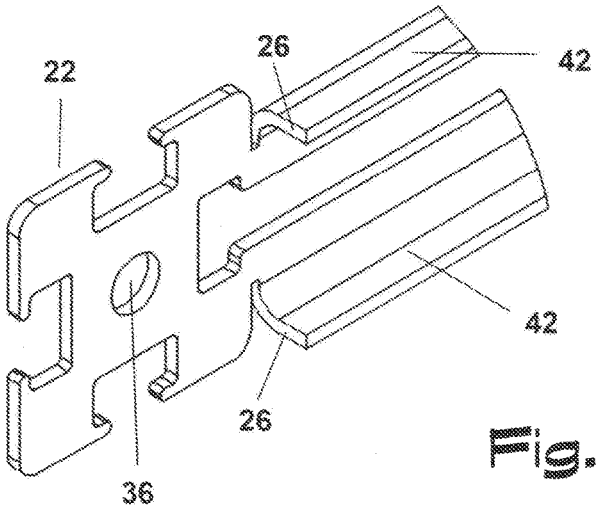
FIG. 2 is a detail drawing of one end of the end plate illustrated in FIG. 6.

An enlarged detail view of one end of the endplate 22 is shown in FIG. 2. Each end of the endplate 22 contains a hole 36 which allows the screws 24 to securely fasten the endplates 22 to the rails 20. The endplates 22 also have two flanges 42 which project perpendicularly from the otherwise flat surface of the end plates 22. The edges 26 of the flanges 42 prevent the rails 20 from rotating around the longitudinal axis of the screws 24, thus keeping the rails 20 perpendicular to each other, and the top work surface 44 of the rails in a common horizontal plane that is generally flat and sturdy. The flanges 42 also strengthen the endplates 22.

Figure 3:
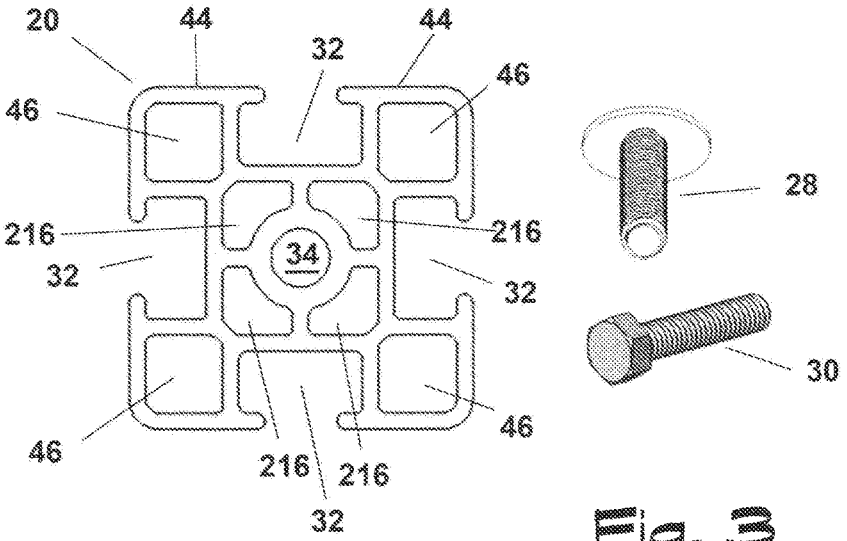
FIG. 3 is an end view of the rail extrusions of FIG. 6 with images of a T-bolt and a Hex Head Bolt.

An end view of the rails 20 is shown in FIG. 3. In the preferred embodiment, the rails 20 are aluminum and have an extruded shape as shown in FIG. 3. The extrusions 20 could be made from other materials such as high strength composites. Although the rails 20 can be any rectangular or rounded shape, a square profile is preferred to minimize cost and weight. In this preferred embodiment the rails 20 include a channel 32 on all four sides of the extrusion. The channels 32 are sized to allow the use of t-track fasteners, such as, hex-head bolts 30 and T-bolts 28 to attach accessories on all four sides of the rails 20. The hex head bolts 30 and T-bolts 28 slide freely along the longitudinal axis of the rails 20 in channels 32. An extruded hole 34 is drilled and tapped at each end of the rail 20 for the use of the assembly screws 24. The cavities 46 and 216 in the extrusions lighten the rails, reduce costs, and facilitate optimized characteristics for easy extrusion of the shape while maintaining a consistent material thickness over the entire extruded profile.

As shown in FIG. 4, the sheet metal end plates 22 have recesses 38 that match the shape of the channels 32 of the rail extrusions 20. The center distance between the holes 36 of the end plates 22 determines the overall width of the rail pair 48 as well as the width of the open space between the rails 20. The value of maintaining these fixed distances will become apparent when various application configurations are described later in this discussion. The three holes 234 are clearance holes for screws so that the rail pairs can easily be attached to other structures. The end plates 22 could also be molded plastic, cast aluminum, stainless steel or aluminum sheets.

A cross-sectional view 5 5—as defined in FIG. 6—of the rail pair assembly 48 is shown in FIG. 5. It is apparent from this view that the edges 26 of the flanges 42 of the end plates 22 will prevent the rails 20 from rotating around the longitudinal axis of the screws 24. The cut-outs 40 in the endplates 22 provide an opening to insert t-track fasteners such as hex-head bolts 30 and T-bolts 28 into the channels 32 of the rails 20 that face each other.

FIGS. 7 through 14 illustrate the structure of the leg support system 132 that supports and positions the rail pairs 48 that form the top surface.

Figure 7:
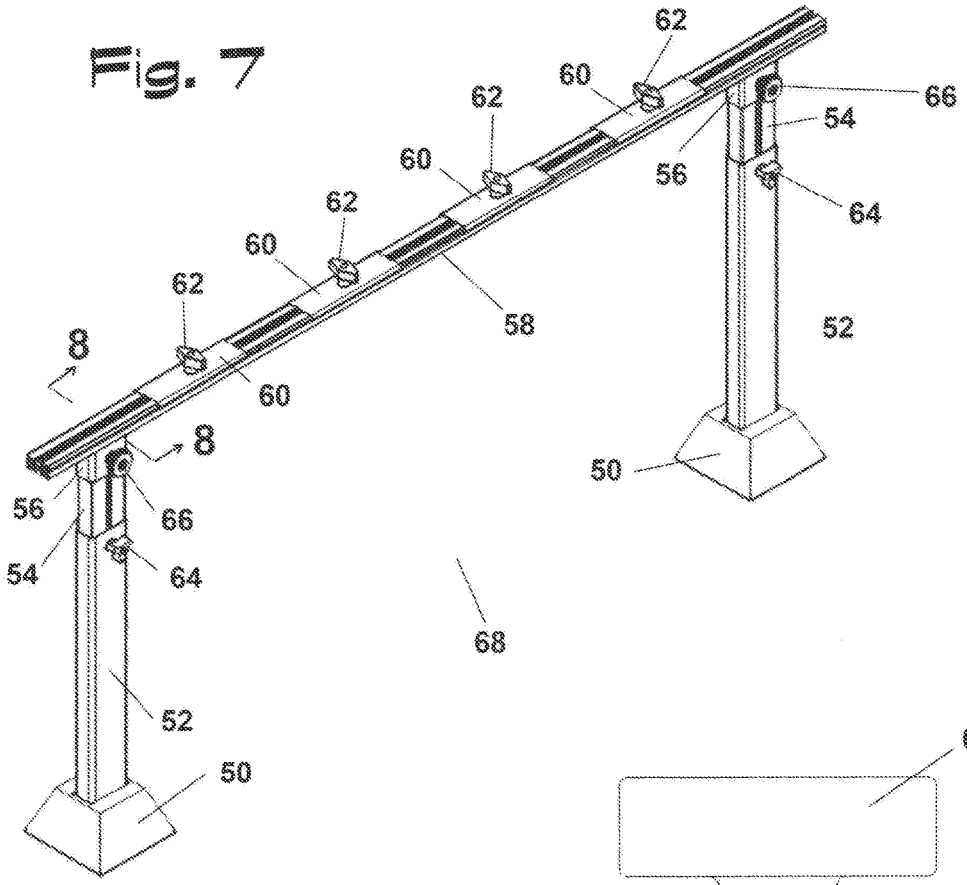
FIG. 7 is a perspective view identifying the components that make up the two-leg support assemblies.

Referring to FIG. 7, a number of rail pair locators 60 are positioned along the length of a horizontal extrusion 58. The locators 60 slide freely and can be positioned anywhere along the length of the extrusion 58. They are locked in position by tightening the knobs 62. The length of the locators 60 match the inside dimension of the rail pairs 48 so that the rail pairs 48 are prevented from movement when aligned with the locators 60.

Figure 8:
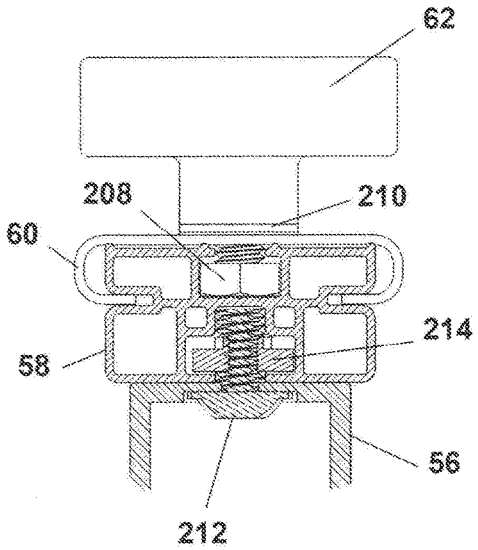
FIG. 8 is a partial cross-sectional view as defined in FIG. 7 showing the means of attaching the rail pair locators and the leg locators to the horizontal extrusion.

As shown in FIG. 8, hex-head bolts 208 slide freely in an upper channel of the extrusion 58. These bolts pass through a hole in the locators 60. As knob 62 is tightened the extrusion is securely trapped between washer 210 and the underside of the hex head of bolt 208. At each end of the horizontal extrusion a leg locator 56 is locked in position by screw 212 and t-nut 214. The leg locators 56 can be positioned anywhere along the length of the lower channel of the horizontal extrusion but are placed a few inches from the ends for greater stability.

Figure 9:
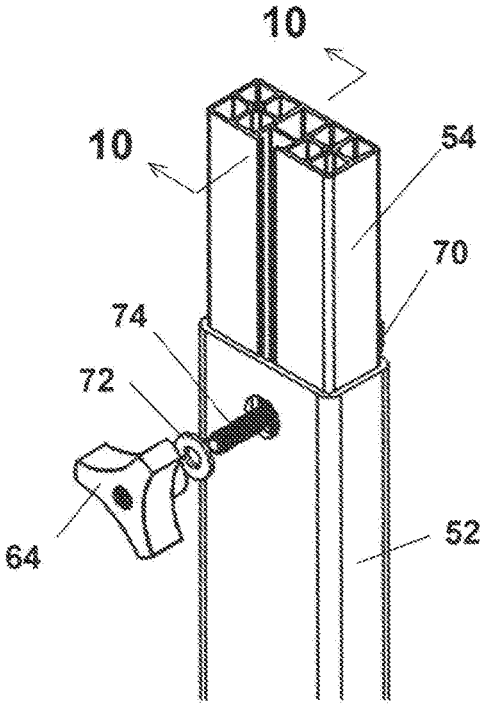
FIG. 9 is a partial view of the leg stand assembly identifying the location of Section 10 10.
Figure 10:
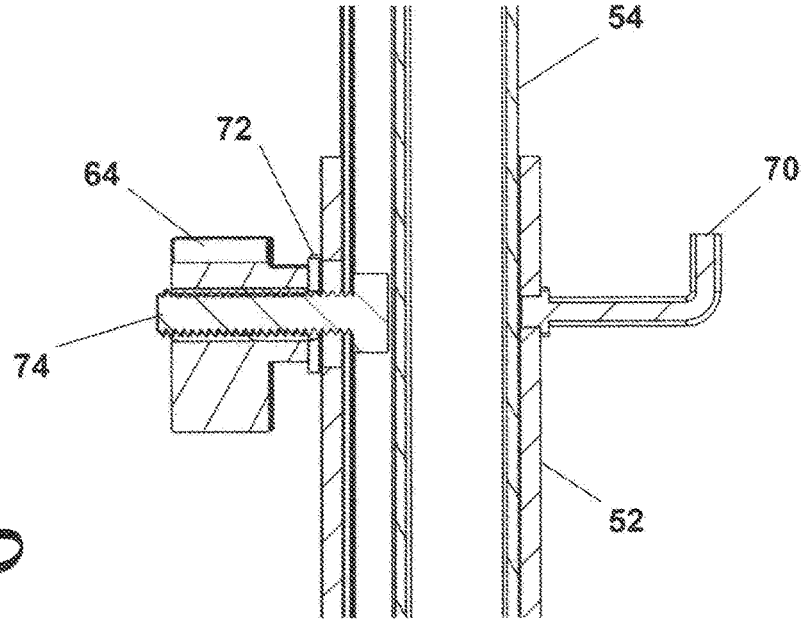
FIG. 10 is a partial cross-sectional view of the leg stand assembly as identified in FIG. 9.
Figure 11:
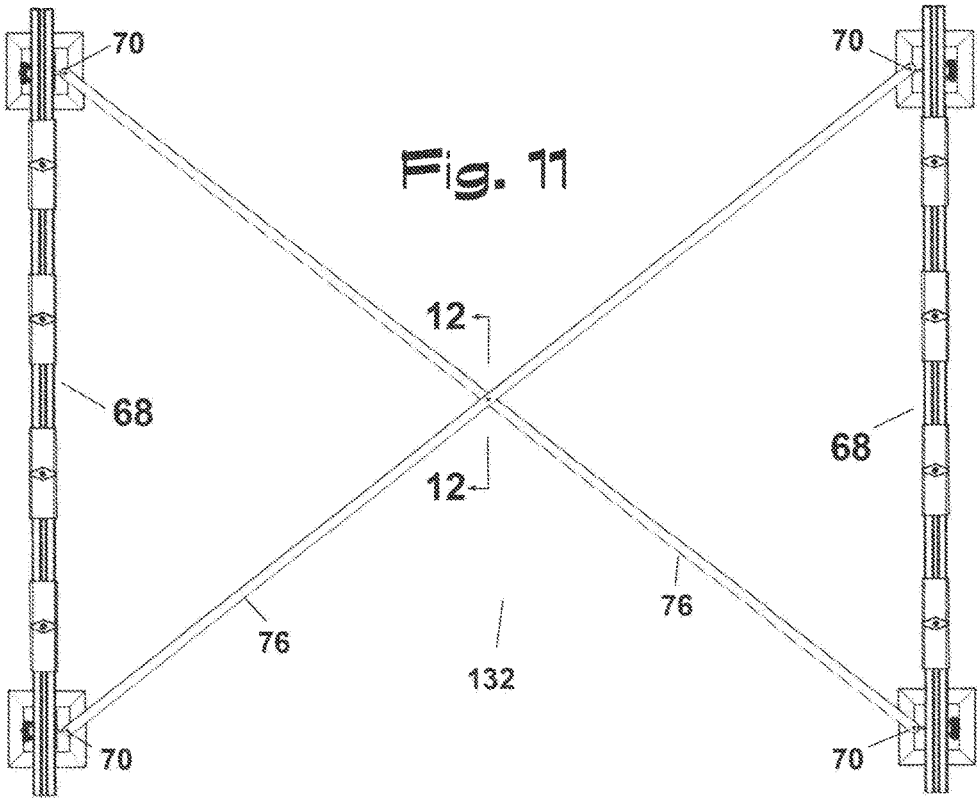
FIG. 11 is a top view of the leg assembly with X-brace and identifies Section 12 12.

Referring to FIGS. 9 and 10, a vertical leg extrusion 54 slides freely inside a leg holders 52. The position of the leg extrusion 54 is locked in place by hex-head bolt 74, washer 72 and knob 64. This position determines the height of the top surface and must be the same for all four legs of the assembly 132 of FIG. 11 if a level work surface is desired. The L hook 70 shown in FIG. 10 is also identified in FIG. 11 and FIG. 13. The X-brace members 76 shown in FIG. 11 attach to these L hooks.

Figure 13:
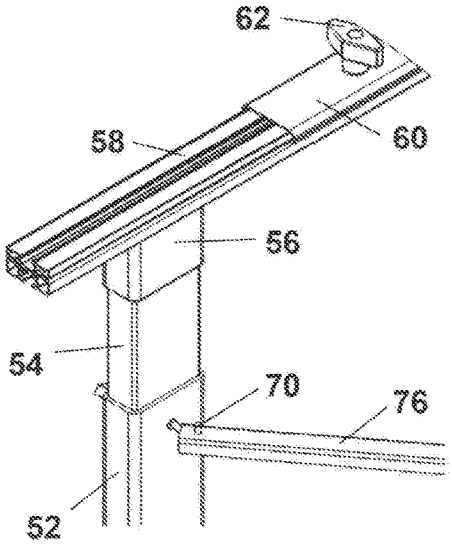
FIG. 13 is a partial perspective view of the leg assembly showing the means of connecting the X-brace to the leg supports.

If the L hooks 70 have the exact same location relative to the leg stand assemblies 68, the leg stands will be parallel to each other and the ends of the horizontal extrusions 58 will form a perfect rectangle when viewed from the top with the X-brace in place. In this configuration, the leg locators 56 must be the exact same distance from the ends of the extrusions 58 and the location of the L hooks 70 must be consistent relative to the leg holders 52. FIG. 13 shows how the X-brace members 76 attach to the L hooks 70.

Figure 12:
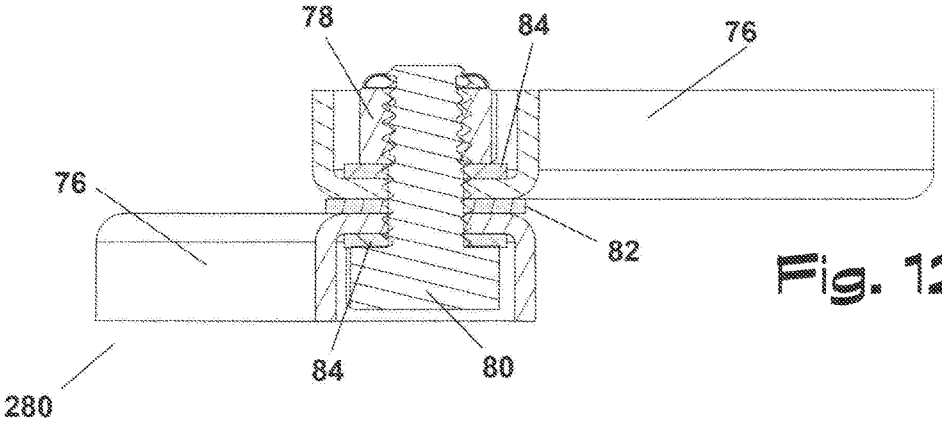
FIG. 12 is a cross-sectional view of the X-brace as defined in FIG. 11.

As shown in the cross-sectional view FIG. 12, the X-brace assembly 280 consists of a pair of u-channels 76 placed back to back and separated by a washer 82: They are joined by a bolt 80 and washers 84 at their center points. A lock nut 78 secures the assembly. The two members 76 have the same length and holes at each end for attaching to the L hooks 70.

Figure 14:
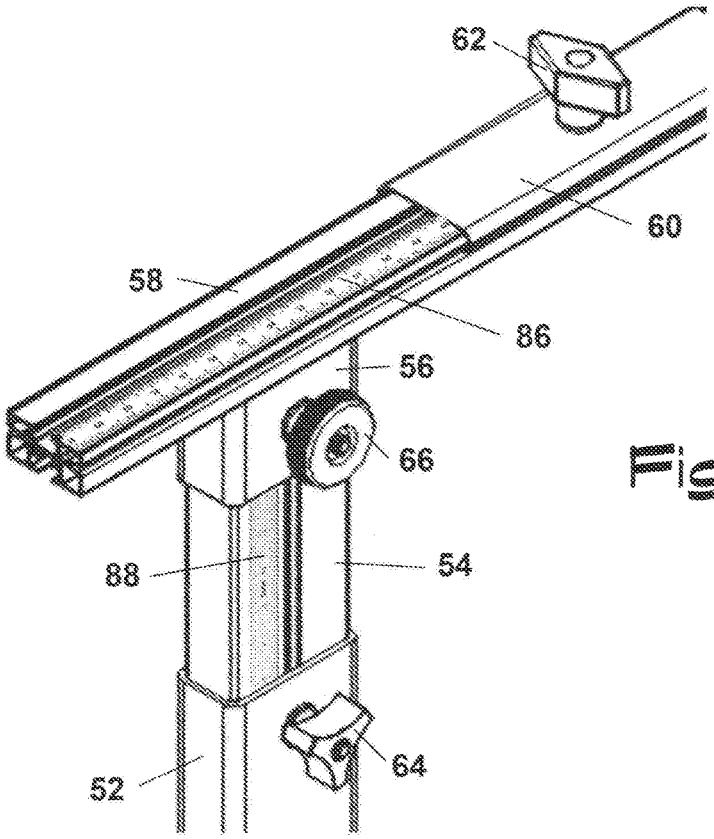
FIG. 14 is a partial perspective view of the leg assembly showing the locations of the vertical scale and horizontal scale.

FIG. 14 shows a vertical scale 88 for adjusting the height of each leg. It also shows a horizontal scale 86 for setting the location of the rail pair locators 60. The vertical scales 88 are on each leg extrusion 54 and the horizontal scales 86 are on each horizontal extrusion 58.

Referring back to FIG. 7, the leg extrusions 54 are connected to the leg locators by bolts and locked in position by knob 66. This arrangement makes it very easy to change the length of the leg extrusion if a greater height is needed for a particular application.

Figure 15:
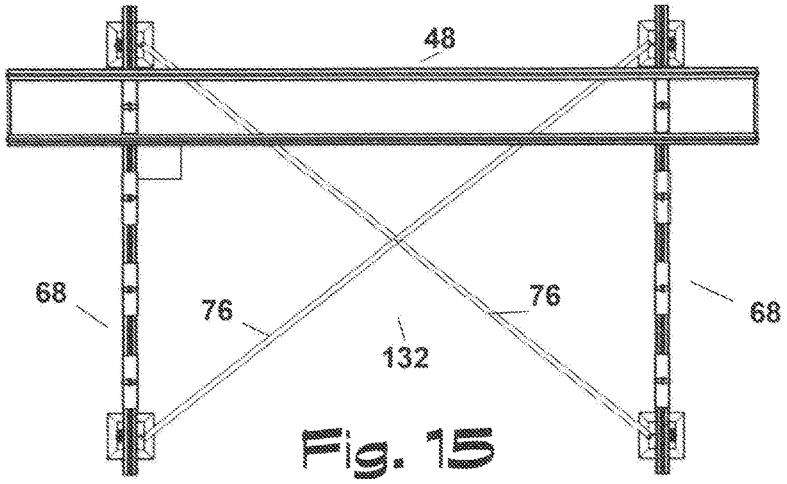
FIG. 15 is a top view of the leg assembly and one rail pair.

As previously mentioned, the leg stands 68 form a perfect rectangle when the X-brace 76 is in place. FIG. 15 shows the entire leg support structure 132 with a single rail pair 48 in place. By use of the horizontal scale 86 in FIG. 14 and the rail pair locators 60 in FIG. 13, the rail pair 48 can be positioned at the same distance from the end of the leg stands 68. When the rail pairs 48 are positioned in this manner, the rail pairs 48 are perpendicular to the leg supports 68. In FIG. 15 the rail pair 48 is indicated to form a right angle with the left leg stand 68. This is noted by the square between the leg support 68 and the rail pair 48.

Figure 16:
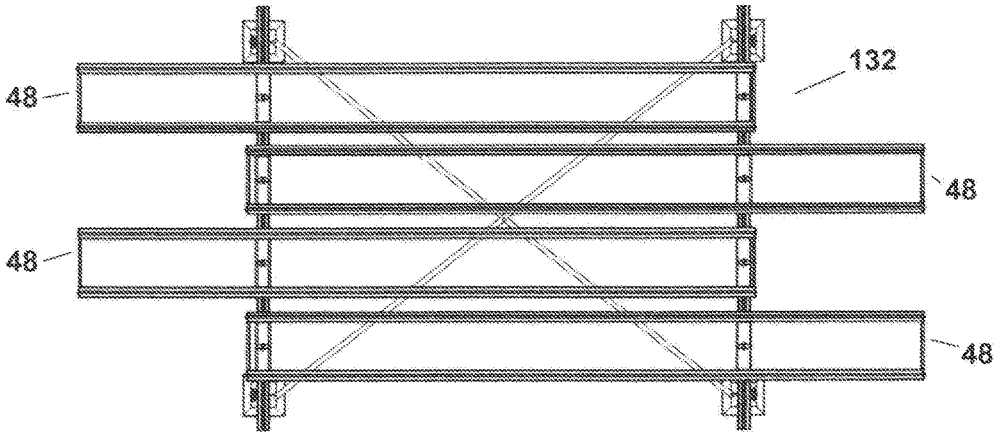
FIG. 16 is a top view illustrating positioning four rail pairs to achieve the maximum table length.

In FIG. 16 four rail pairs 48 are positioned in such a way as to maximize the overall length of the table top that they form.

FIG. 17 is a perspective view of the basic system set up as a work table. The basic system consists of leg stand assembly 132 and four rail pairs 48. Leg stand assembly 132 includes two leg stands 68 with X-brace assembly 280. This combination of components is sufficient for most applications.

FIG. 18 shows the composition of a single leg stand 180. It uses the same components as the leg stands 68 shown in FIG. 7 except that the horizontal extrusion 58 is shortened **58*a* to support a single rail pair 48**. This stand is used for several applications described in later illustrations.

FIG. 19 is a perspective view of a wall mounted storage bracket 90. FIGS. 20 and 21 illustrate how the brackets 90 are used to store the rail pairs 48 and leg stands 68.

In most cases, the open grid created by the rail pairs 48 is advantageous. It makes it easier to clamp materials to the table top formed by the rail pairs 48. It also provides clearance when cutting materials supported by the work surface. FIGS. 22 through 24 illustrate an optional solid surface top 134 that can easily be added to a rail pair 48 when a solid surface is required. In the preferred embodiment, the solid surface is a panel of ¼ inch plywood 92 with two attached runners 94 that align with the channels 32 in the rail pair extrusions 20 as identified earlier in FIG. 3.

FIGS. 25 through 29 illustrate the use of the system for cabinet assembly.

Figure 25:
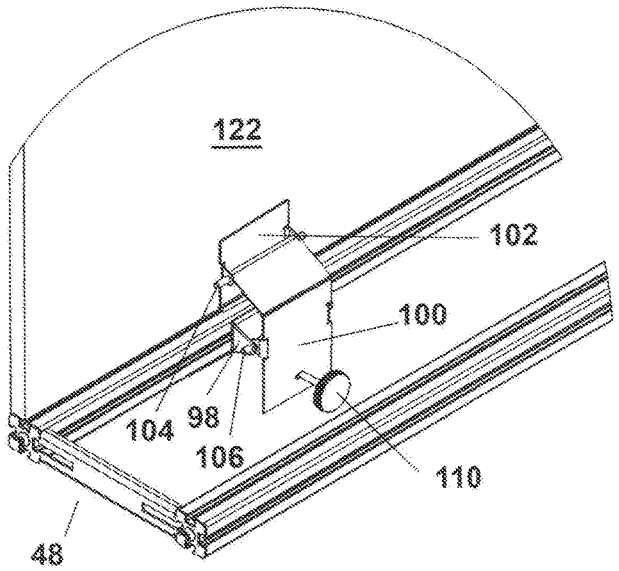
FIG. 25 is a partial perspective view illustrating the use of the interior panel clamp of FIG. 26 and FIG. 29.
Figure 26:
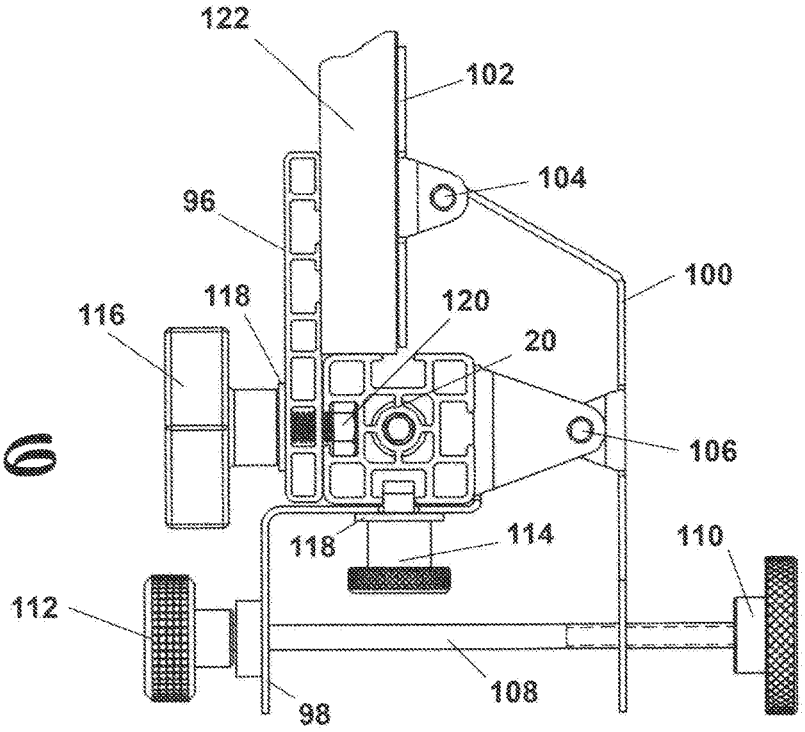
FIG. 26 is a partial perspective end view illustrating the clamping of a panel.

Referring to FIGS. 25 and 26, a panel 122 is trapped between an external extrusion 96 and an internal clamping surface 102. The panel 122 rests on top of a rail pair 48 extrusion 20. The external extrusion 96 is secured to the rail pair 48 extrusion 20 by three bolts 120 that ride in the outside extrusion channel and are secured by knobs 116 pressing against washers 118. The internal clamping is provided by clamping plate 102 which is attached to actuator 100 by pin 104. Clamping plate 102 rotates freely around pin 104 thus allowing it to align with the surface of the panel 122. The actuator 100 is attached to a mounting bracket 98 by a pin 106. Actuator 100 freely rotates around pin 106. The mounting bracket 98 aligns with the bottom channel of rail pair 48 extrusion 20 and is locked in place by a hex bolt (not shown) that rides in the bottom extrusion channel and knob 114 acting against washer 118. A partially threaded rod 108 passes through a hole in mounting bracket 98 and is threaded through a hole in actuator 100. Knobs 112 and 110 are rigidly connected to rod 108. Either knob 112 or 110 can be used to tighten the clamping plate 102, thus the clamp can be tightened from the interior or exterior of the cabinet panels 122.

Figure 28:
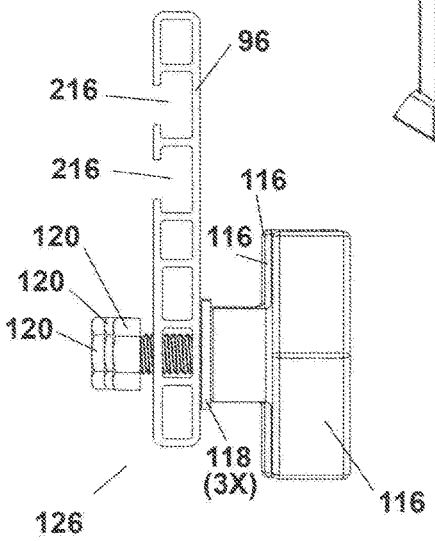
FIG. 28 is an end view of the universal edge guide shown in FIG. 26 and FIG. 27.

FIG. 28 illustrates the components that are combined to create the universal edge guide 126. This universal edge guide 126 is used in numerous applications of the system. Three bolts 120 pass through evenly spaced holes in the extrusion 96. The holes are positioned so that the bottom of the extrusion 96 will align with the bottom of the rail pairs 48 when clamped in place. Three knobs 116 provide clamping pressure against three washers 118. The extrusion 96 also includes two hex bolt channels 216 so that other items can be attached for greater versatility of the system.

Figure 29:
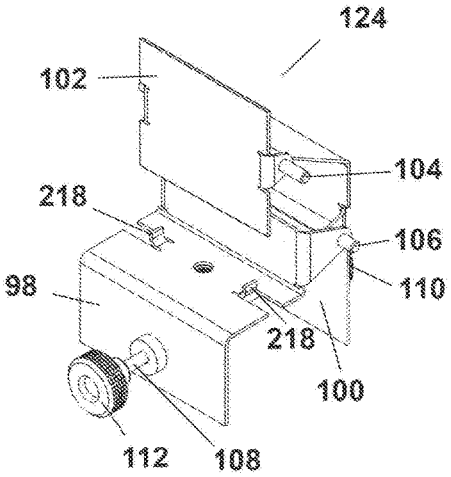
FIG. 29 is a perspective view of the interior panel clamp.

FIG. 29 shows a perspective view of the internal panel clamp 124. It is referred to as internal because it is used between the two extrusions 20 of the rail pairs 48. The mounting bracket 98 contains two tabs 218 that align with the bottom channel of the extrusions 20 of the rail pairs 48.

Figure 27:
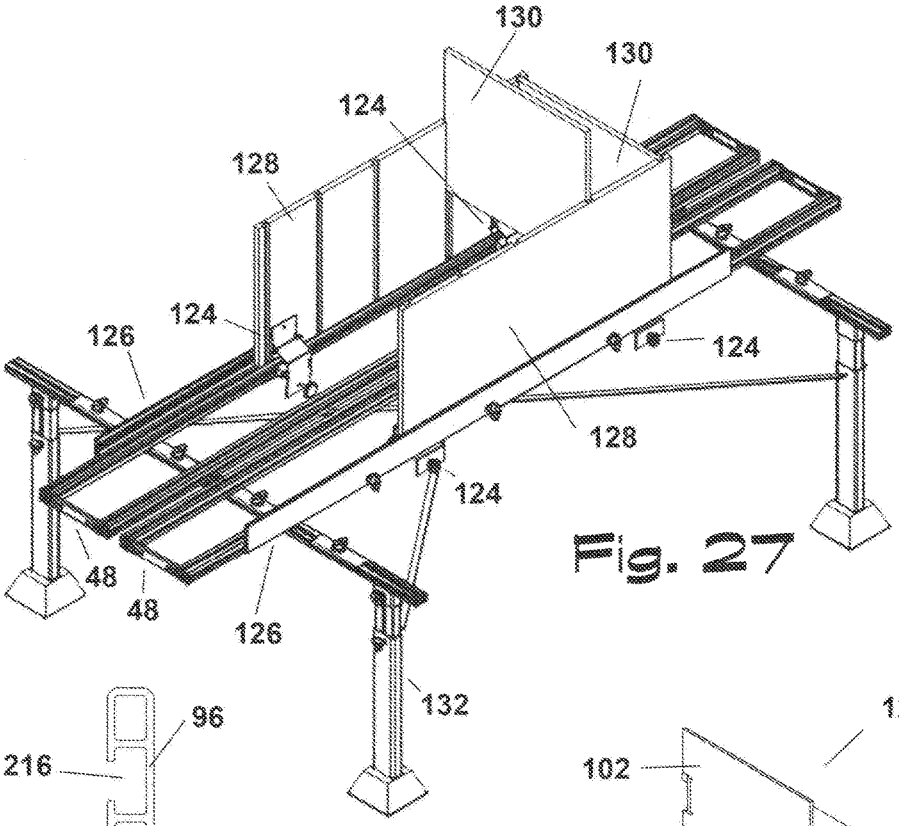
FIG. 27 is a perspective view illustrating the configuration for cabinet assembly.

FIG. 27 is a perspective view of the system configuration used for cabinet assembly. Rail pairs 48 are positioned such that their combined width matches the width of the cabinet to be assembled. Universal edge guides 126 are attached to the exterior edges of each rail pair 48 and locked in place by tightening knobs 116 identified in FIG. 28. Four internal panel clamps are attached to the rail pairs 48 as illustrated in FIG. 27. The side panels 128 of the cabinet are then positioned on top of the rail pairs 48 and clamped securely by turning knobs 112 or 110. End panels and shelves 130 can then slide into place. With the cabinet components firmly located the cabinet can be glued or otherwise fastened with minimal effort. Because the rail pairs 48 are parallel to each other and perpendicular to the leg stand assembly 132 it is very easy to square up the cabinet before gluing or fastening the panels and shelves. A carpenter's square can quickly verify the alignment. If the diagonals of the cabinet are measured and a minor adjustment needs to be made, one side panel can be locked in place while the opposite panel is gently nudged into position.

Figure 30:
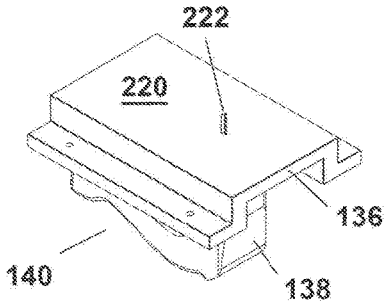
FIG. 30 is a perspective view of a jigsaw attached to a mounting bracket.
Figure 31:
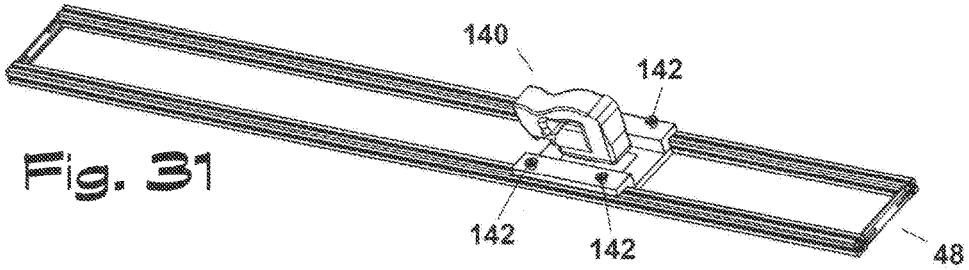
FIG. 31 is a perspective view of the jig saw mounted to a rail pair.
Figure 32:
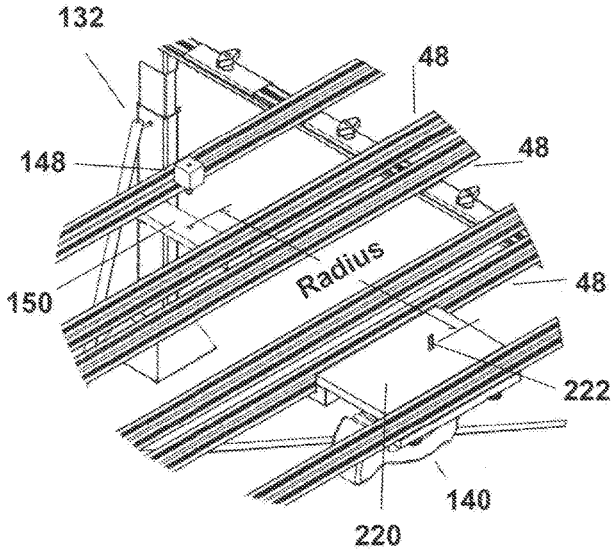
FIG. 32 is a partial perspective view of the configuration for cutting circles.
Figure 33:
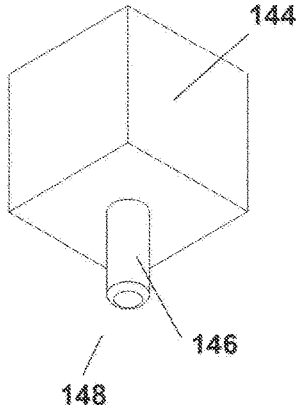
FIG. 33 is a perspective view of the center pin assembly used to cut circles.

FIGS. 30 through 34 illustrate the use of the system to cut large circular panels. FIG. 30 shows a jig saw 138 mounted to a mounting bracket 136. This combination 140 is then attached to a rail pair 48 with hex bolts, washers and knobs 142 as illustrated in FIG. 31. As illustrated in FIG. 32, the rail pair 48 is then positioned on the leg stand assembly 132 such that the jig saw blade protrudes through the top of the mounting bracket 136. The bracket surface 220 is coplanar with the top of the rail pairs 48. A plate 150 is attached to the underside of another rail pair 48. The plate 150 has a hole which matches the diameter of pin 146 of FIG. 33. Pin 146 is rigidly connected to block 144 as illustrated in FIG. 33. The top surface of the combination 148 is attached to a square panel at its center point. This can usually be done adequately with double sided tape. The distance between the hole in plate 150 and the jig saw blade 222 determines the diameter of the round panel to be cut.

Figure 34:
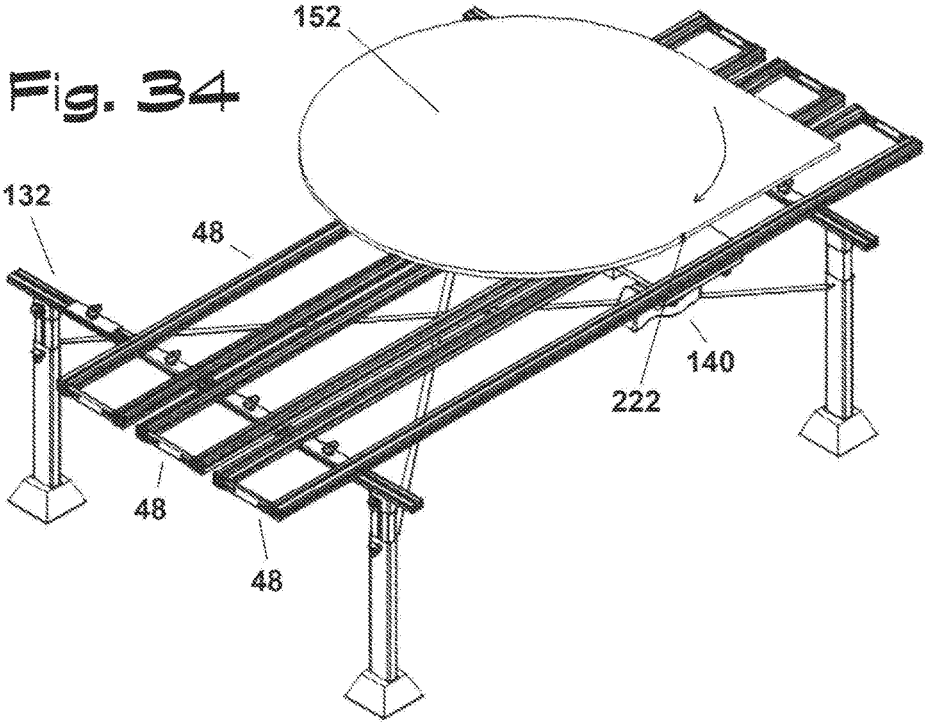
FIG. 34 is a perspective view of the configuration for cutting a large circular panel.

FIG. 34 is a perspective view of the circle cutting configuration in use. Rail pairs 48 are positioned on the leg stand assembly 132 in a way that supports the panel 152 while it is rotated into the jig saw blade 222.

Figure 35:
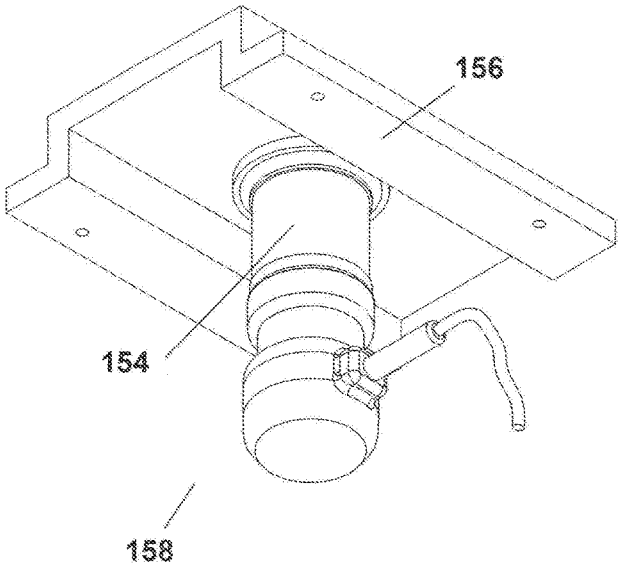
FIG. 35 is a perspective view of a router attached to a mounting bracket.

If a router 154 is mounted to a bracket 156 as illustrated in FIG. 35, it can be positioned the same as the jig saw assembly 140 in FIG. 34. In this case the edge of the circular panel can be refined and the top and bottom edges rounded.

FIGS. 35 through 41 illustrate some of the many uses of the system with respect to the use of a router. As previously mentioned and illustrated in FIG. 35, a router assembly 158 can be created by attaching a router 154 to a bracket 156 that fits between the extrusions of a rail pair 48.

Figure 36:
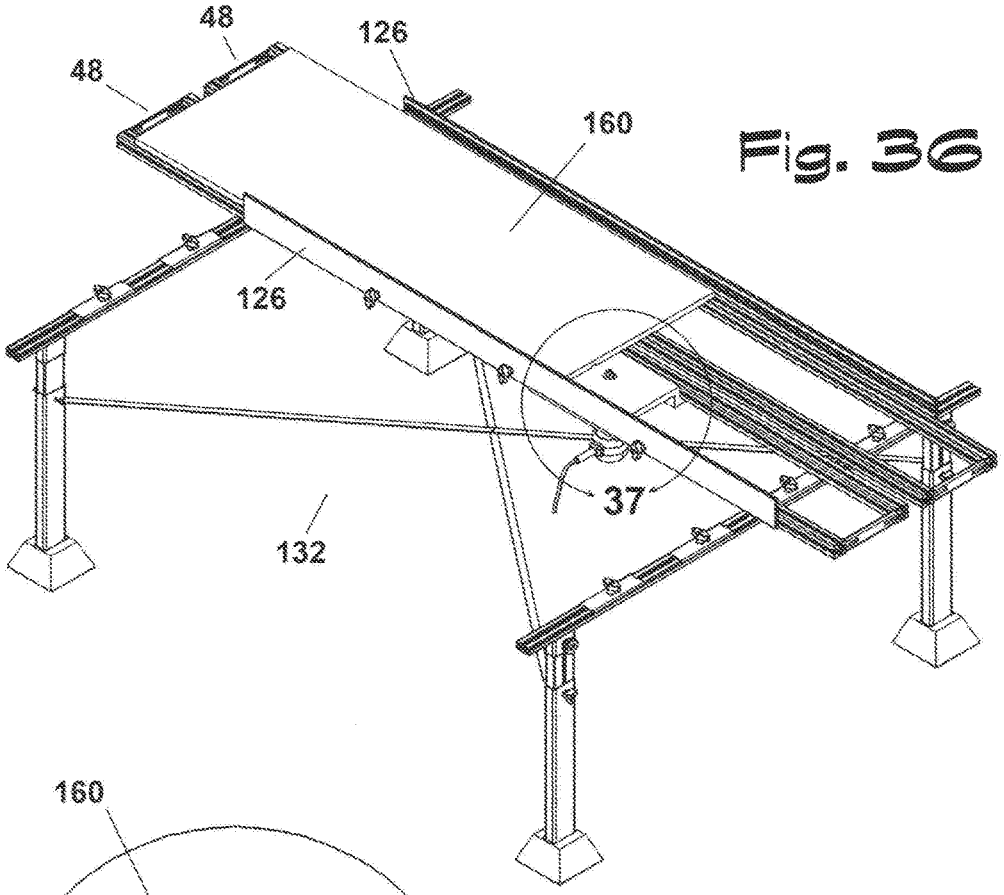
FIG. 36 is a perspective view of the configuration for cutting long channels using the router assembly of FIG. 35.
Figure 37:
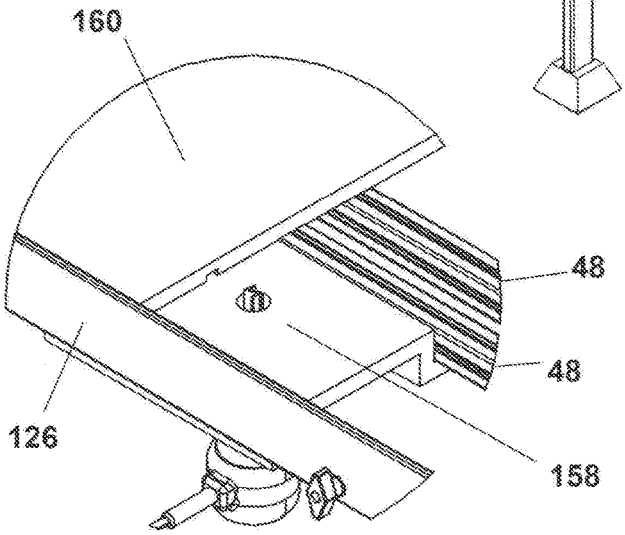
FIG. 37 is a perspective detail view as defined in FIG. 36.

If this router assembly 158 is attached to the underside of a rail pair 48, it can be used in a number of configurations. FIGS. 36 and 37 show the configuration for routing long slots. Often, shelving is made adjustable by the use of shelf standards mounted to the inside of a cabinet. The shelf standards are often mounted in shallow recesses so that they are flush with the panel surface. In the configuration depicted in FIG. 36, two rail pairs 48 have been positioned to match the width of the panel to be routed. Universal edge guides 126 are attached to the outside of the rail pairs 48 to insure that the panel is limited to movement in only one direction—that of the cut. The detail view of FIG. 37 shows the slot created by the cut. After the first slot is cut, panel 160 is rotated 180° and the cut is repeated. This results in slots that are equal distanced from the edges of the panel 160—common practice for positioning shelf standards.

Figure 38:
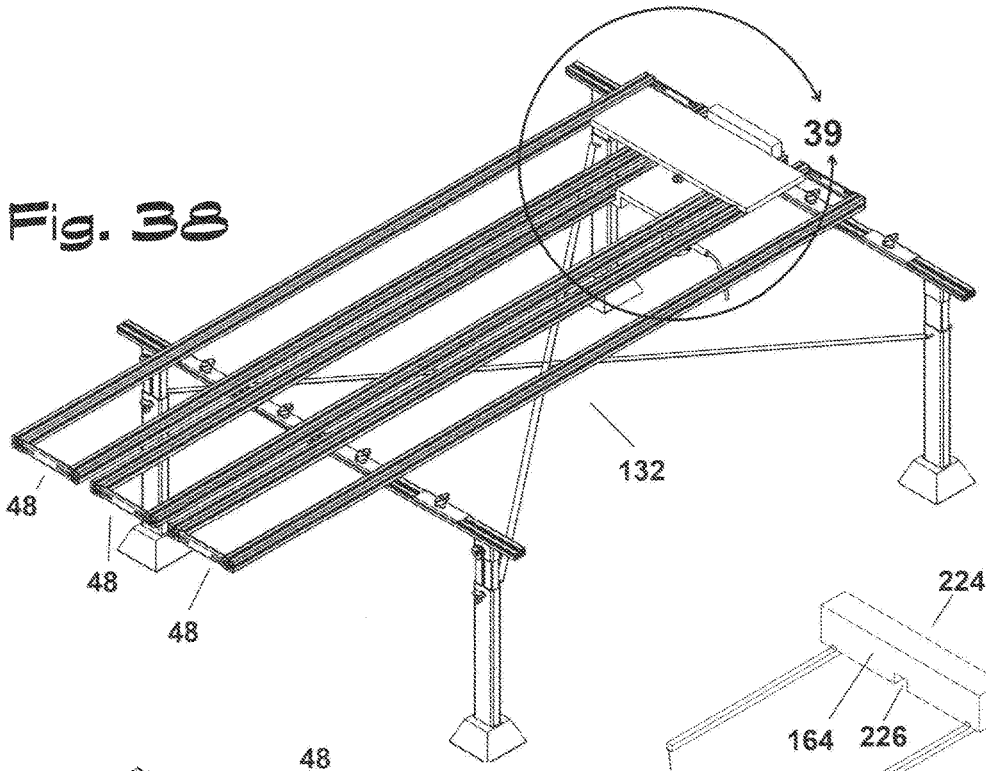
FIG. 38 is a perspective view of the configuration for cross-cutting dados.
Figure 39:
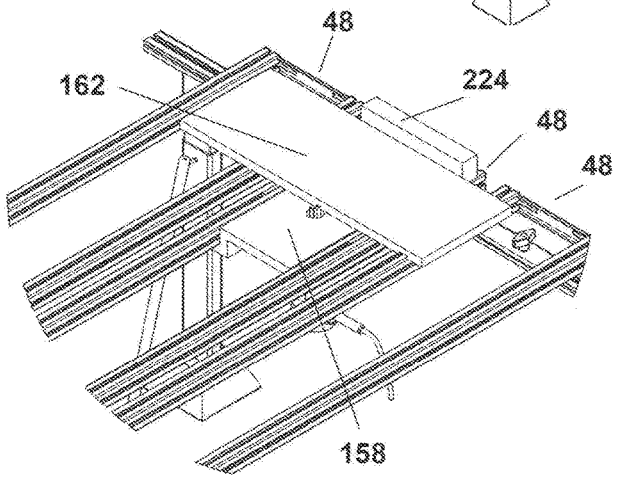
FIG. 39 is a perspective detail view as identified in FIG. 38.
Figure 40:
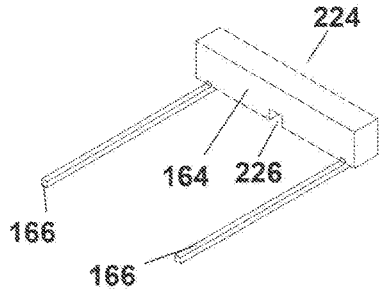
FIG. 40 is a perspective view of the guide sled used in FIG. 38 and FIG. 39.

FIGS. 38 through 40 illustrate routing dados in a narrow panel 162. A crosscut sled 224 is formed by block 164 and rails 166. Block 164 is notched 226 to allow the router bit to freely pass through the block 164. The rails 166 fit snugly in the channels of the rail pairs 48 but do not break the plane of the work surface formed by the rail pairs 48. When the panel 162 is pushed over the router bit by crosscut sled 224, the dado formed will be perpendicular to the edges of the panel 162. A clamp can be added to crosscut sled 224 to prevent unwanted movement of panel 162 during the routing process. A scale or adjustable detents can also be added to crosscut sled 224 to insure regularly spaced dados or dados at a particular distance from an edge.

Figure 41:
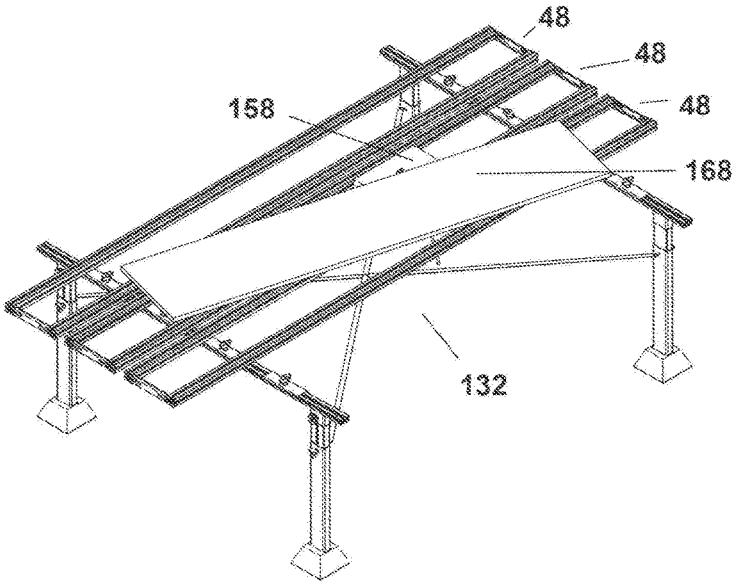
FIG. 41 is a perspective view of the configuration for routing edges of large panels.

FIG. 41 illustrates a much simpler configuration used to round edges on panels 168. In this case the router assembly 158 is positioned to optimize support from rail pairs 48 while routing the edges. If the round over bit has a ball bearing guide, no fence is required to perform this task. The work surface created by the rail pairs 48 is large enough that even large panels can easily be moved around the surface without the need for lifting.

Figure 42:
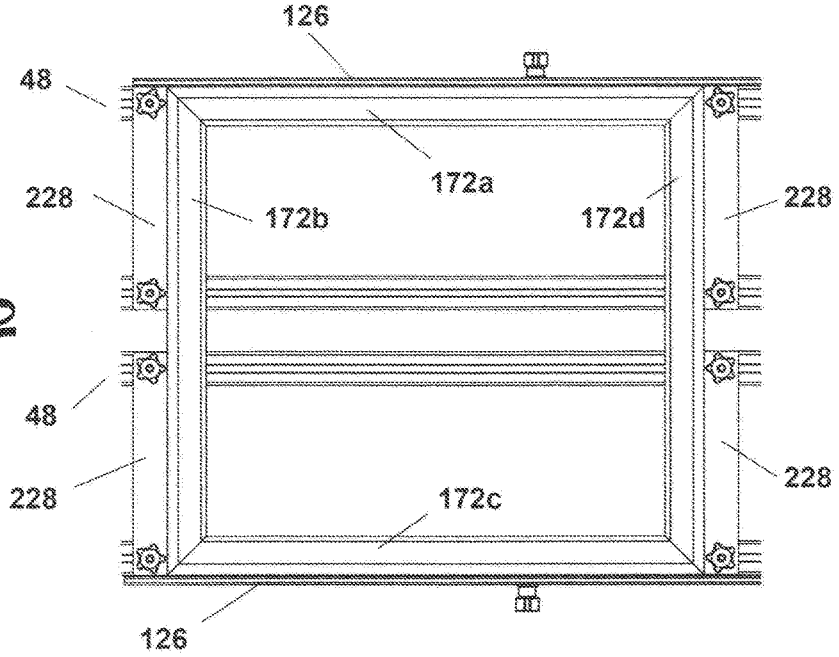
FIG. 42 is a top view of the setup for assembling frames.
Figure 43:
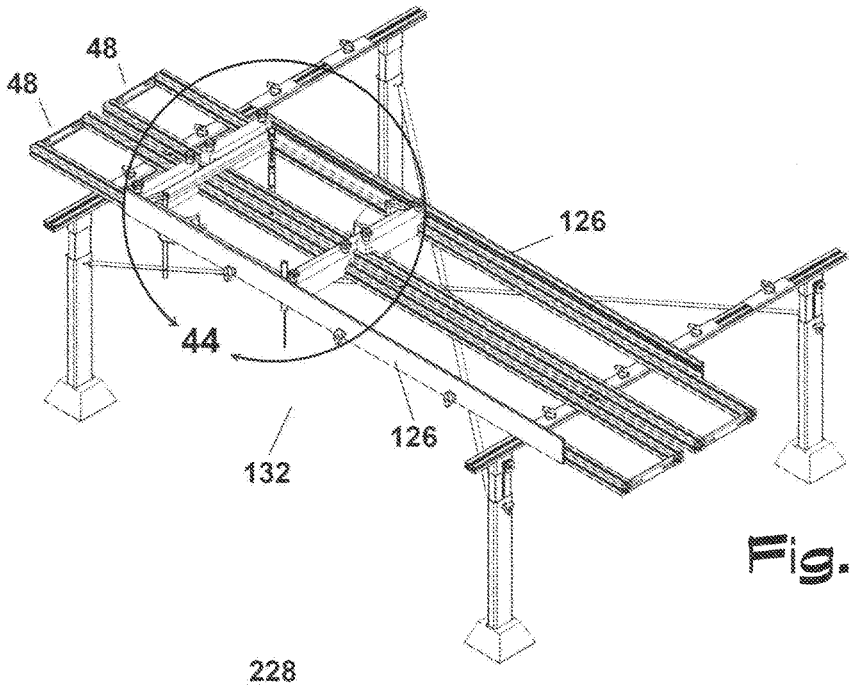
FIG. 43 is a perspective view of the configuration for assembling frames.
Figure 44:
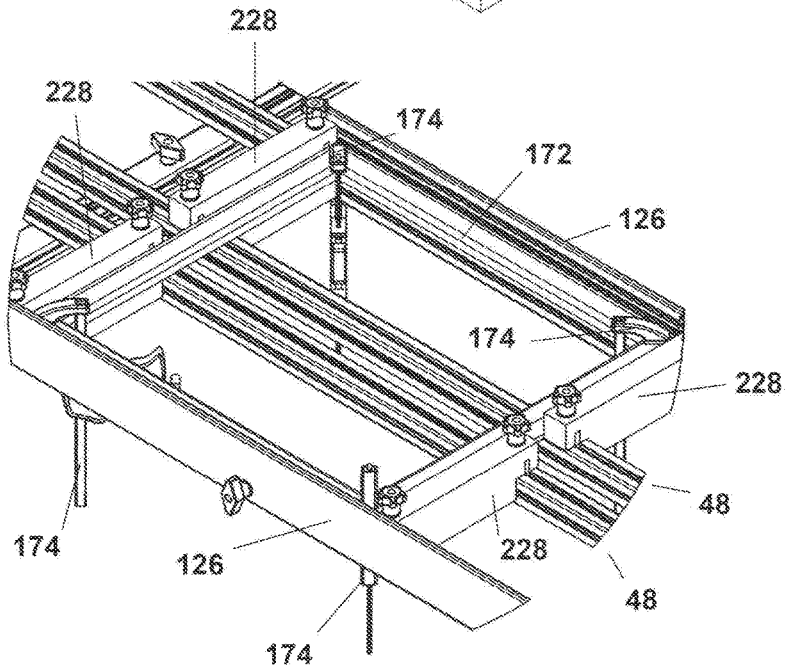
FIG. 44 is a perspective detail view as defined in FIG. 43.
Figure 45:
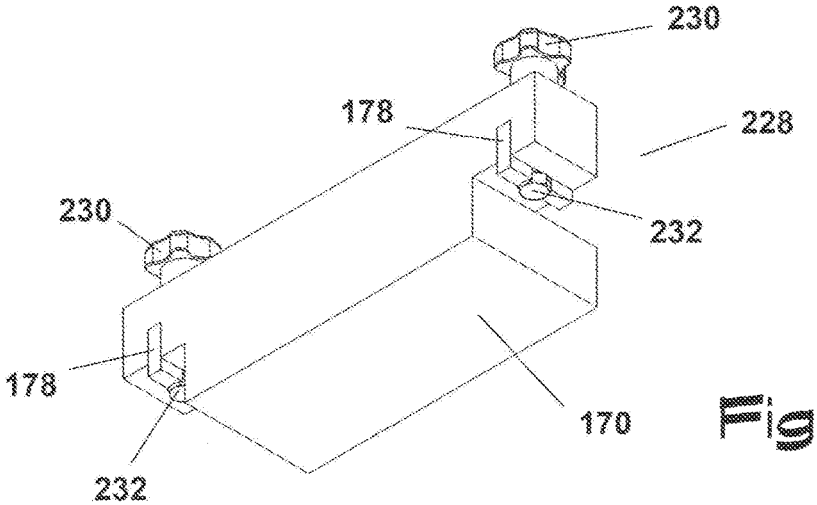
FIG. 45 is a perspective view of the braces used in the framing application of FIGS. 42 thru 44.

FIGS. 42 through 45 illustrate the configuration used for assembling frames such as picture frames, face frames, door panels, and screens. FIG. 42 is a top view of the set up. Universal edge guides 126 are adjusted to prevent movement in one direction and insure that the sides are parallel. The four sides of the picture frame 172 are placed between the universal edge guides 126. The universal edge guides 126 are separated by the length of frame components 172 *b* and 172*d*. Picture frame components 172*a* through 172*d* are supported by rail pairs 48 and constrained by universal edge guides 126. Rail Pair edge guides 228 are then moved into position to fully constrain the frame components. The rail pair edge guides are held perpendicular to the rail pairs 48 by rails 178 and locked in position by knobs 230 as illustrated in FIG. 45.

FIGS. 43 and 44 are perspective views of the framing setup. FIG. 45 shows the details of the setup and shows how clamps 174 can be added to further constrain the frame components 172*a* through 172*d* while glue dries or fasteners are secured. The open-grid of the rail pairs 48 provides numerous opportunities for clamping.

FIG. 45 illustrates the structure of the rail pair edge clamps 228. Blocks 170 fit between the extrusions of the rail pairs 48 and extend under the frame components. Rails 178 guide the assembly and help to maintain a perpendicular relationship to the rail pairs 48. Hex bolts 232 slide in the rail pair channels and provide a means for securing the rail pair edge guides 228. Knobs 230 apply pressure to washers not shown and clamp the rail pair edge guides in place.

Figure 46:
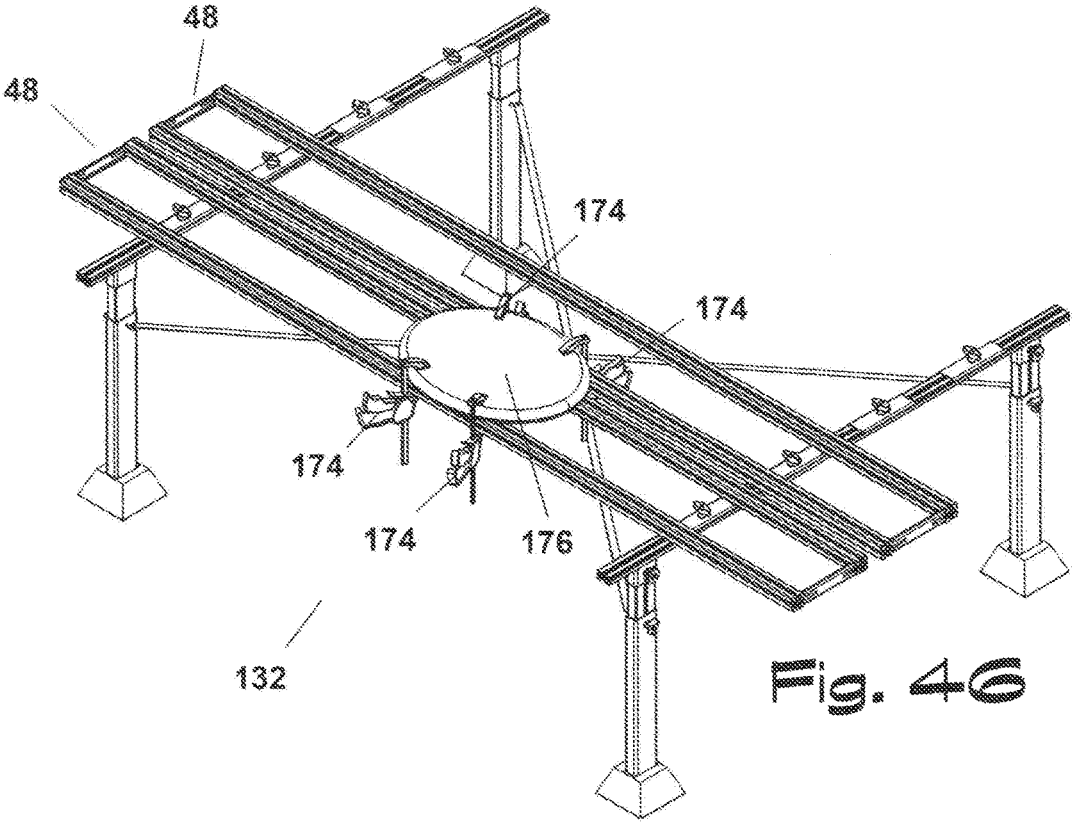
FIG. 46 is a perspective view of the setup for clamping odd shaped objects.

FIG. 46 is a perspective view of the system illustrating how odd shapes can be easily clamped in place due to the open grid nature of the rail pairs 48 that form the top work surface. An oval shaped object 176 is secured to rail pairs 48 by clamps 174.

FIGS. 47 through 53 illustrate the configuration of the system to act as a table saw slide table.

FIG. 47 shows a table saw 186 mounted to a stand 184. A frame 188 is also attached to the stand 184. Frame 188 has a slot 282 in its top surface that mates with rail 200 of FIG. 51 and FIG. 52.

FIG. 48 shows the structure of the brace 190 that connects the table saw stand to a single leg stand 180. The support 240 connects to the frame 188 of the table saw stand 182 through the bottom member of frame 188. Support 240 is secured in place by two bolts 244, two washers 246, and two knobs 242. The bolts 244 pass through holes in the frame 188. Member 238 is rigidly attached to support 240 and secured in a perpendicular relationship to support 240 by two angle braces 236. A bolt 248 passes through a hole in member 238. Bolt 248 is used to secure the brace 190 to the leg stand 180 in FIG. 49 and is locked in place by washer 246 and knob 242.

FIG. 49 shows the table saw assembly 182 rigidly connected to single leg stand 180 by brace 190. Brace 190 insures that leg stand 180 is a fixed distance from the plane of the saw blade and perpendicular to it.

Figure 50:
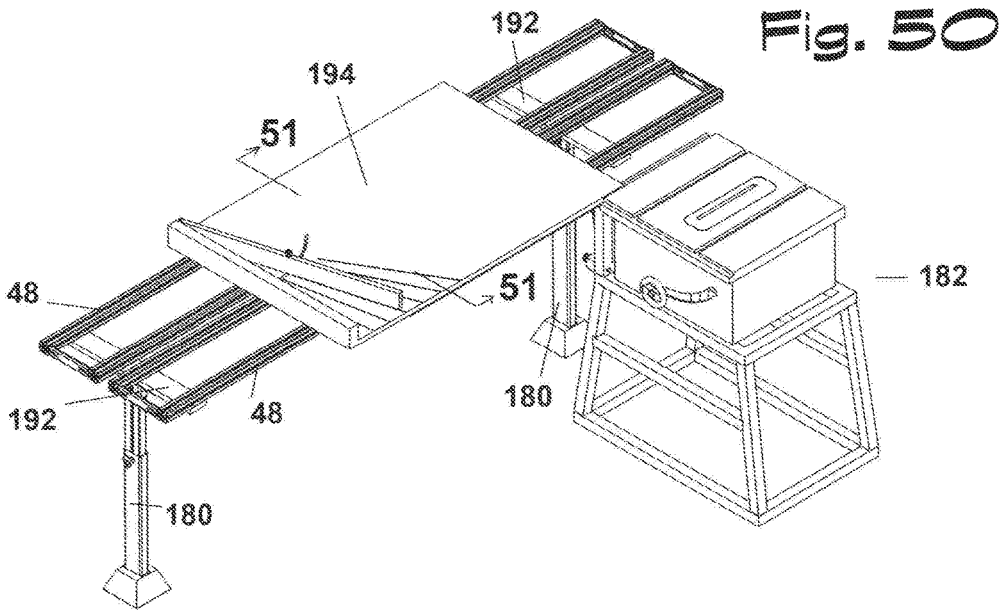
FIG. 50 is a perspective view of a table saw with a slide table.

FIG. 50 is a perspective view of the slide table configuration. Two rail pairs 48 are supported by two single leg stands 180. A locator 192 is attached to each leg stand to support and locate the two rail pairs 48. The leg stand 180 closest to the table saw is rigidly positioned relative to the table saw assembly 182 by brace 190 as illustrated in FIG. 49. The other leg stand 180 is guided by the rail pairs 48 now positioned by the first leg stand 180. The slide table 194 slides freely along the rail pairs 48 in a line that is parallel to the saw blade cutting plane.

Figure 51:
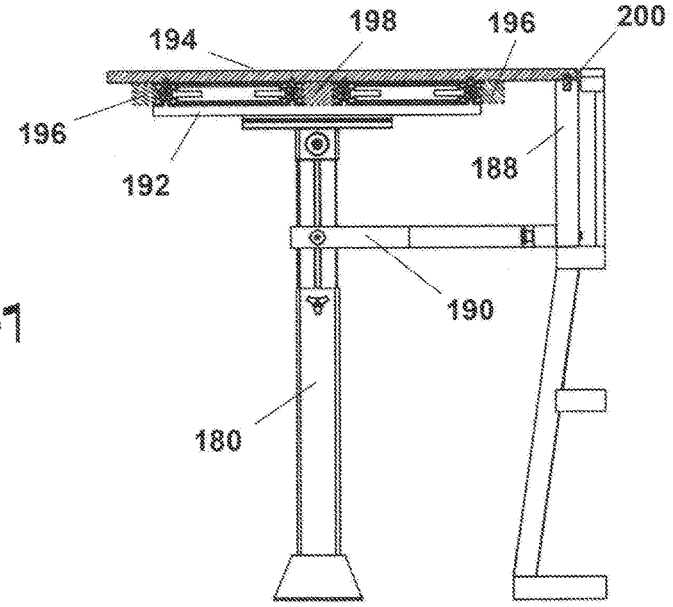
FIG. 51 is a cross-sectional view as defined in FIG. 50.
Figure 52:
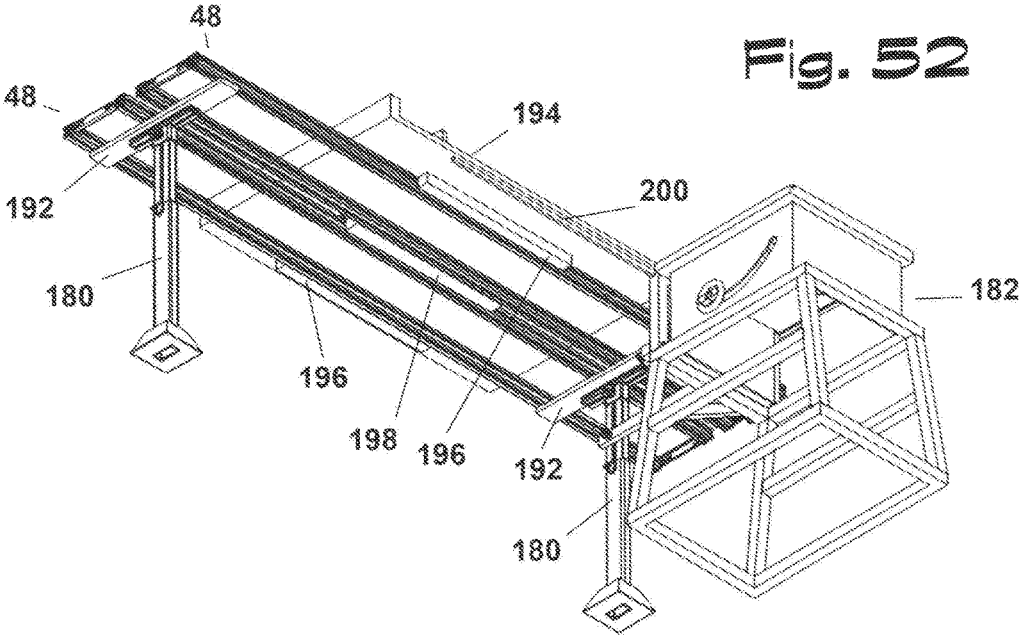
FIG. 52 is a perspective view of the underside of the slide table configuration of FIG. 50.

FIG. 51 is a cross-sectional view of the slide table configuration as indicated in FIG. 50. Guide blocks 196 and 198 attach the slide table 194 to the rail pairs 48 and constrain the movement of the slide table 194. A rail 200 is also attached to slide table 194. It slides through a notch 282 in frame 188 which is rigidly attached to the saw table stand 184 of the assembly 182. FIG. 52 is a perspective view of the underside of the slide table configuration. Guide blocks 196 and 198 are seen in perspective as well as guide rail 200.

Figure 53:
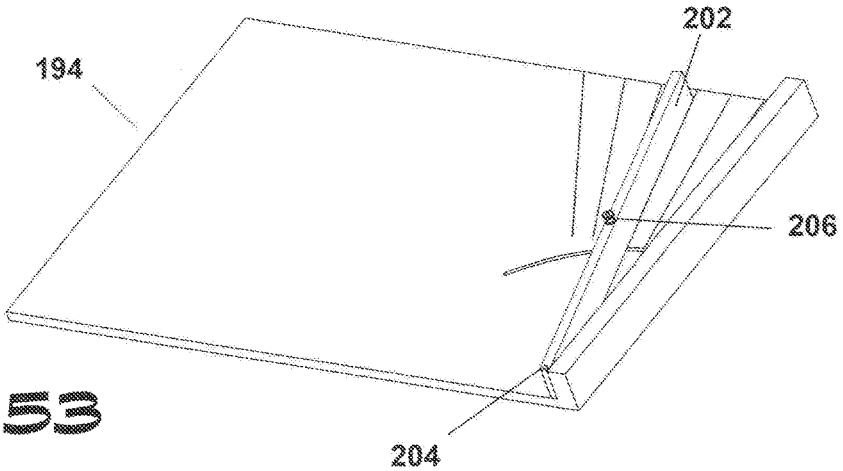
FIG. 53 is an isolated perspective view of the slide table.

FIG. 53 illustrates the removable protractor 202 that is attached to the slide table 194. Protractor 202 pivots around pin 204 and is clamped in place by knob 206 which acts on a bolt and washer that are not shown. Lines are etched into the surface of the slide table corresponding to set angles.

Figure 54:
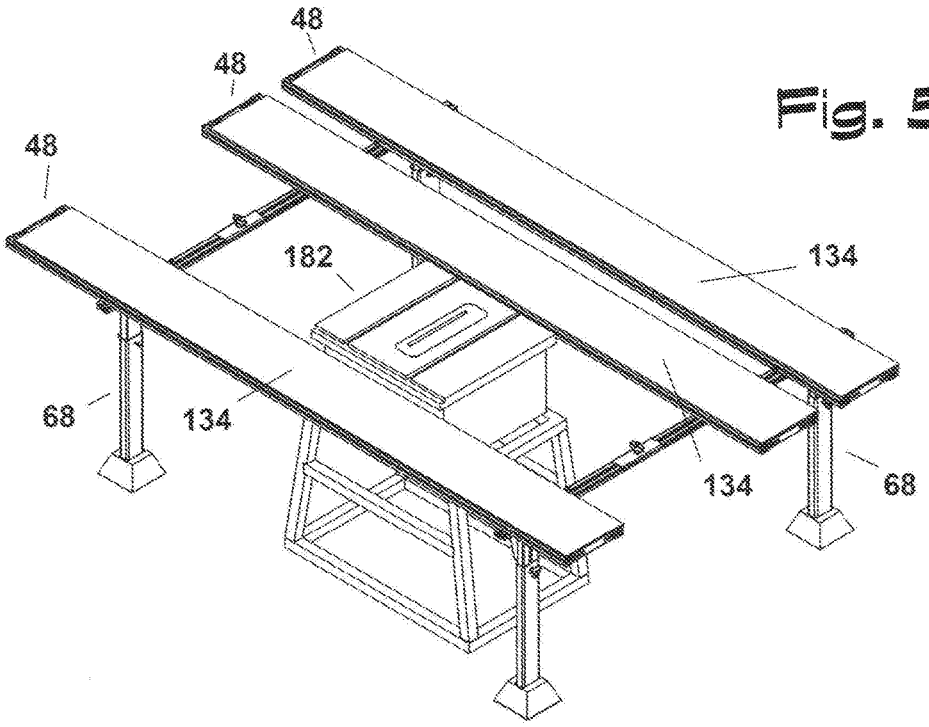
FIG. 54 is a perspective view of the configuration for infeed and outfeed tables for a table saw.

FIG. 54 shows one of many possible configurations that act as infeed and outfeed tables for tools such as table saws and planers. In this case leg stands 68 are used without the X-brace assembly 280. One rail pair 48 is positioned in front of the table saw and two rail pairs 48 are positioned behind the table saw. Each rail pair is covered by a solid top 134. This set up provides excellent support for large panels in both the infeed and outfeed modes.

FIGS. 55 through 59 illustrate the configuration of the system for use as a panel saw.

Figure 55:
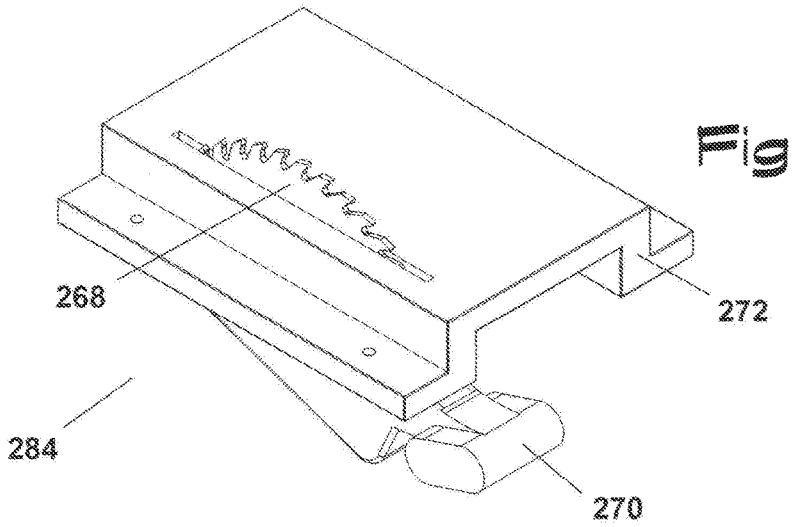
FIG. 55 is a perspective view of a circular saw attached to a mounting plate.

FIG. 55 shows a circular saw attached to a mounting plate. Circular Saw 270 is attached to mounting plate 272 and the blade 268 projects above the top surface of mounting plate 272. The assembly is designated as 284.

Figure 56:
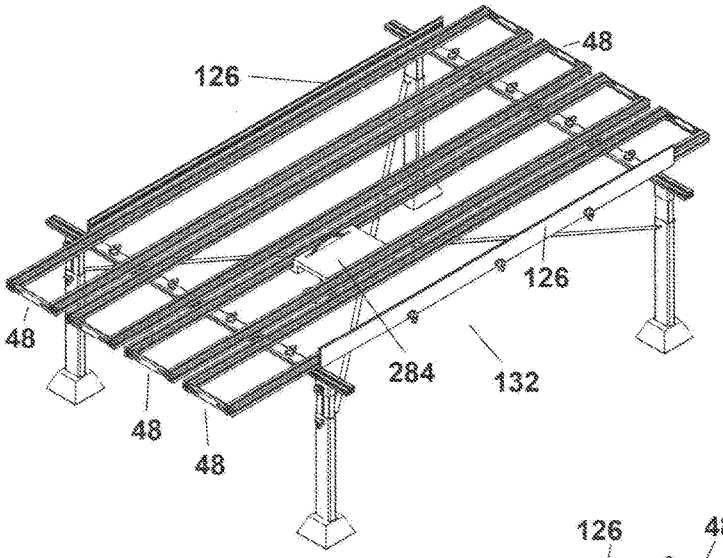
FIG. 56 is a perspective view of the rail system configured as a panel saw in the rip mode.

FIG. 56 illustrates the set up for ripping large panels. The circular saw assembly 284 is attached to a rail pair 48 such that the blade projects above the plane of the top surface of the rail pairs 48. Universal edge guides 126 are attached to the outer edges of the two rail pairs 48 that define the total width of the top surface. The distance between the two universal edge guides 126 matches the width of the panel to be cut. The rail pair 48 containing the circular saw assembly 284 is positioned on the leg stand assembly 132 according to the desired width of cut. Additional rail pairs 48 are used for a support surface.

Figure 57:
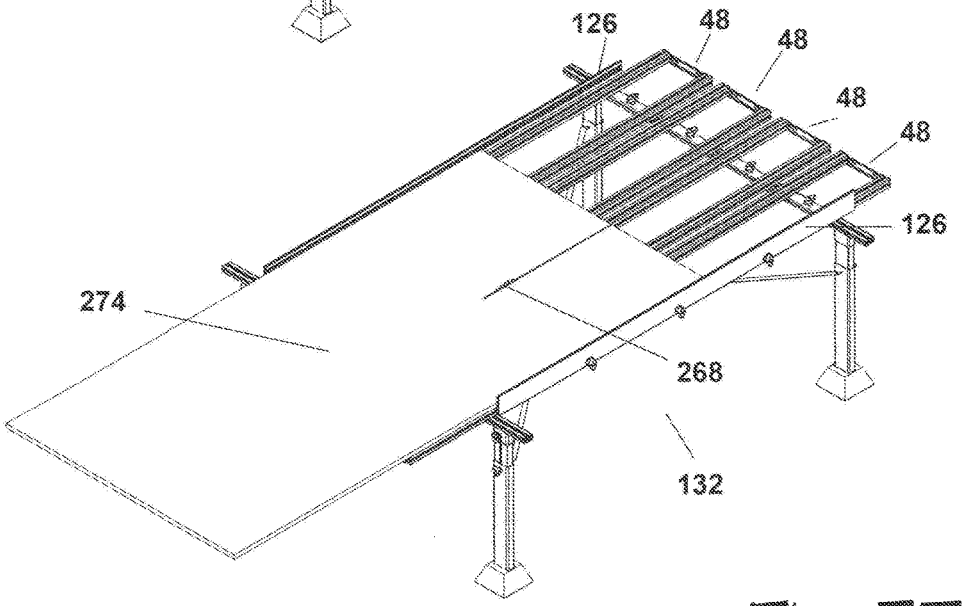
FIG. 57 is a perspective view of using the rail system to rip a 4×8 panel.

FIG. 57 illustrates a large (4×8) panel 274 being ripped using this setup. Universal edge guides 126 trap the panel and maintain a cut line that is parallel to the long edges of the panel 274 as the panel is pushed through the rotating saw blade 268.

FIG. 58 illustrates one design for a cross-cut sled 250 that is used to control and guide the panel when the setup is used in a cross-cut mode. Guide block 254 is shaped so that it rides on the top surface of a rail pair 48 in FIG. 59 and projects through the space between the two rails of the rail pair 48. Two guide rails 252 are rigidly attached to guide block 254. These guide rails 252 fit snugly in the upper T-track channels of the rail pair extrusions 20 in FIG. 59. The shape of guide block 254 and the guide rails 252 insure that the cross-cut sled 250 can only move in a direction that is parallel to the rail pair 48 extrusions 20 in FIG. 59. Guide block 254 contains two vertical slots 264. A clamp block 256 contains two holes 266. Bolts 258 pass through holes 266 in clamp block 256 and vertical slots 264 in guide block 254. Clamp block 256 is secured to guide block 254 by washers 260 and knobs 262. Clamp block 256 is pushed in a vertical direction until it contacts panel 276 of FIG. 59. It is then locked in place with knobs 262.

FIG. 59 illustrates cross-cutting a large panel 276. The panel 276 is placed on the top surface formed by rail pairs 48. Cross-cut sled assemblies 250 are then positioned on at least two rail pairs 48. With panel 276 firmly supported before making contact with the saw blade 268, the cross-cut sleds 250 are positioned to contact the far edge of the panel 276 in FIG. 59. The clamp blocks 256 of FIG. 58 are then pressed against the top surface of the panel 276 and locked in place by knobs 262 of FIG. 58. As the panel 276 is pushed through the rotating saw blade the cross-cut sleds 250 insure that the cut is perpendicular to the long edges of the panel 276.

Figure 60:
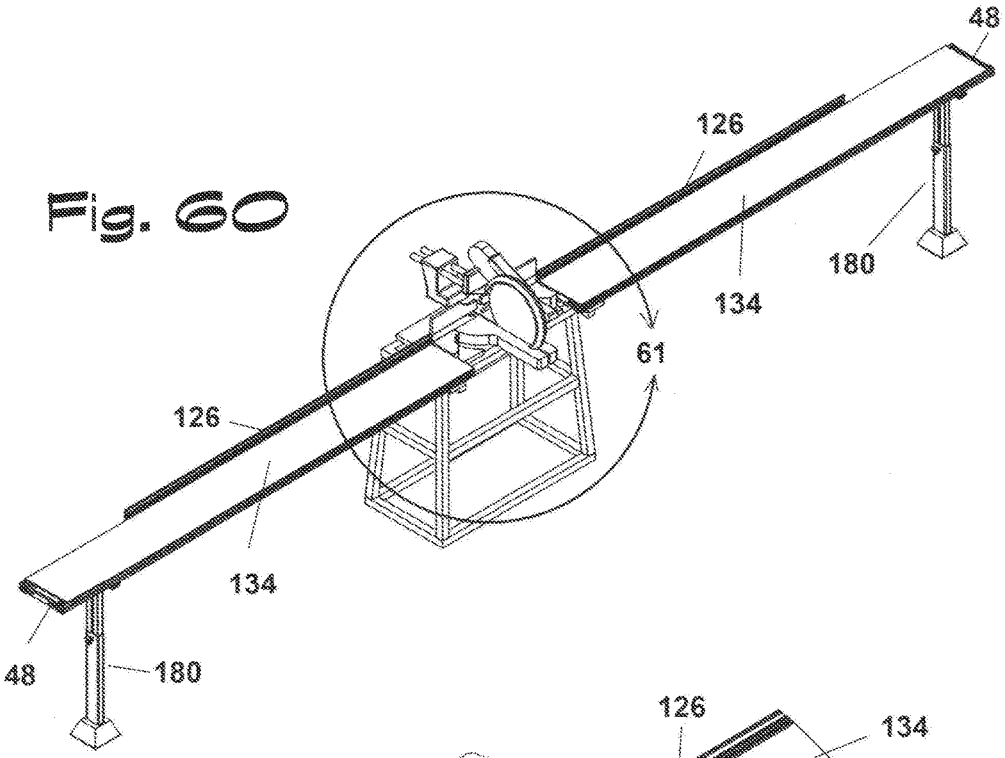
FIG. 60 is a perspective view of the configuration for a miter saw stand
Figure 61:
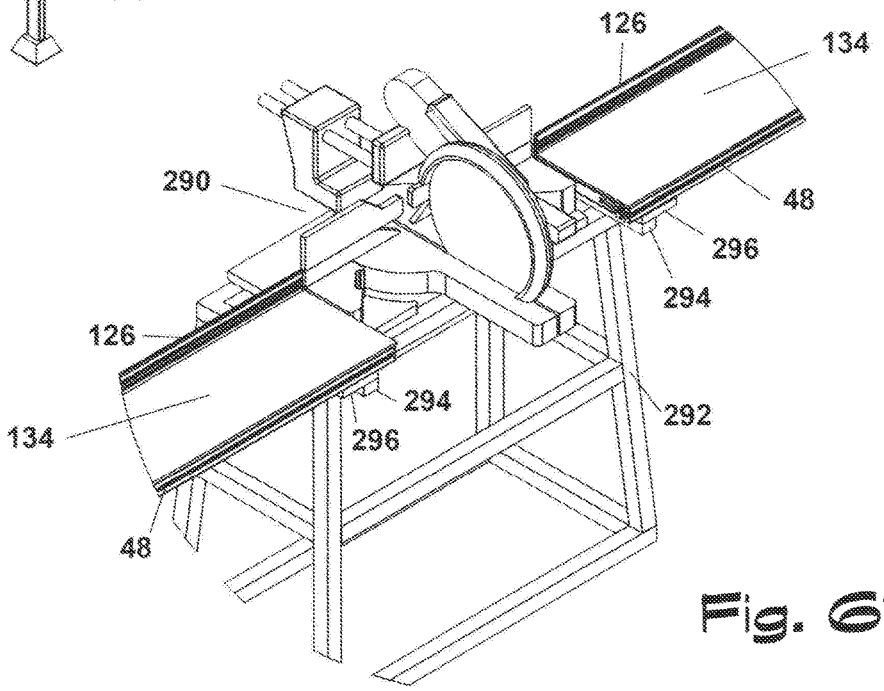
FIG. 61 is a detail perspective view as indicated in FIG. 60
Figure 62:
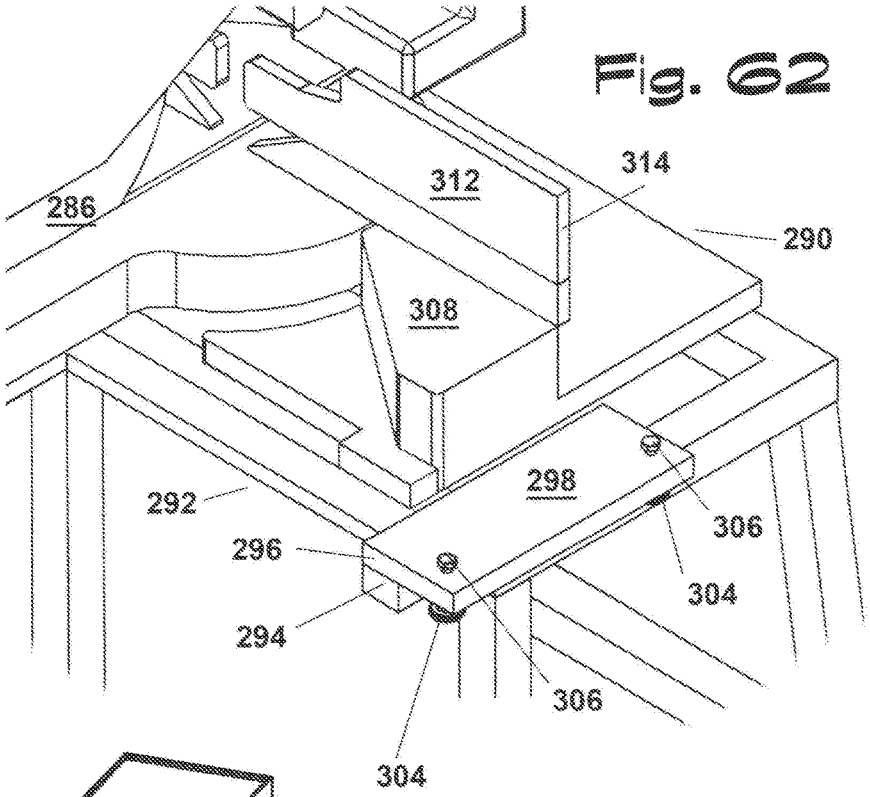
FIG. 62 is partial perspective view of the Miter Saw Stand of FIGS. 60 and 61 showing the means of mounting the rail pairs to the stand.

FIGS. 60 through 62 illustrate a miter saw stand that has been designed to be used with components of this system. It is illustrative of a line of power tool stands that simplify and enhance material handling and material support during cutting operations.

Miter saw stands that are currently available only have one point of support on either side of the miter saw. These supports are frequently rollers which produce a single line of contact with the material being supported. In the case of flat surfaces instead of rollers, the area of support is still normally very small. In both cases, the material supports need to be moved frequently as material is cut. They also typically only extend a maximum distance of 4 feet to either side of the saw blade when it is set for a 90° cut. Dimensional lumber, specifically 2× materials are readily available in lengths up to 16 feet. Thus, miter saw stands that are currently available are not designed to support these longer boards.

FIG. 60 and detail FIG. 61 show a miter saw 290 mounted to a miter saw stand 292. The miter saw stand 292 also includes support members 294 and mounting members 296 on either side of the miter saw 290. Rail pairs 48 are attached to either side of the miter saw 290 and supported by single leg stands 180. Solid top assemblies 134 are placed on top of the rail pairs 48. Universal edge guides 126 are also mounted to each rail pair 48.

FIG. 62 shows the details of the mounting structure of FIGS. 60 and 61. Support members 294 project out the front of the miter saw stand 292. They are positioned parallel to the plane of the saw blade 286 when the miter saw is set for a 90° cut. The support members 294 match the width of the rail pairs 48 and their back faces align with the plane of the face 312 of the miter saw fence members 314. Mounting members 296 are rigidly attached to support members 294. The top surface 298 of mounting members 296 are parallel to the plane of surface 308 of miter saw 290. The distance between these two planes matches the thickness of rail pairs 48 and solid tops 134 so that a continuous support plane is created when all components are in place. Rail Pairs 48 are secured to mounting plates 296 by bolts 306 and knobs 304.

The configuration depicted in FIG. 60 provides continuous support for dimensional lumber as large as 2×12×16.

Figure 63:
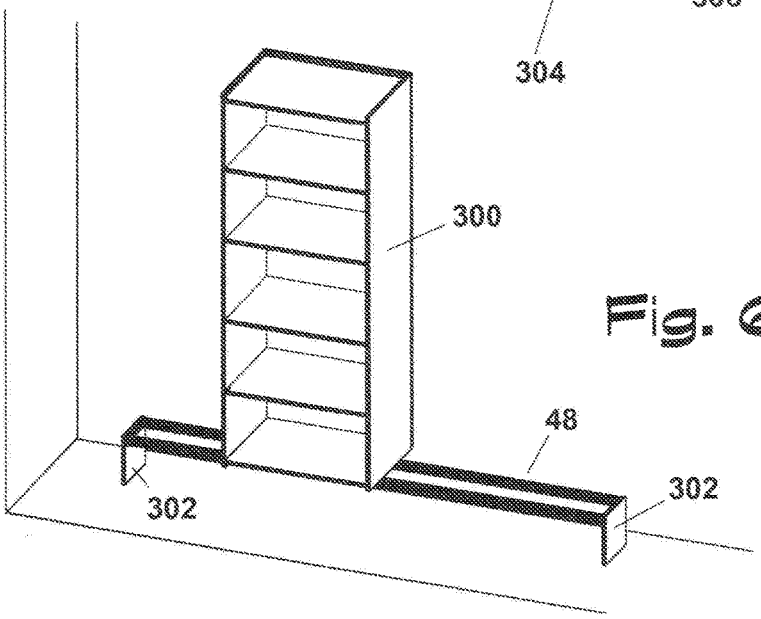
FIG. 63 is a perspective view showing a rail pair supporting a tall cabinet during the wall mounting operation.
Figure 64:
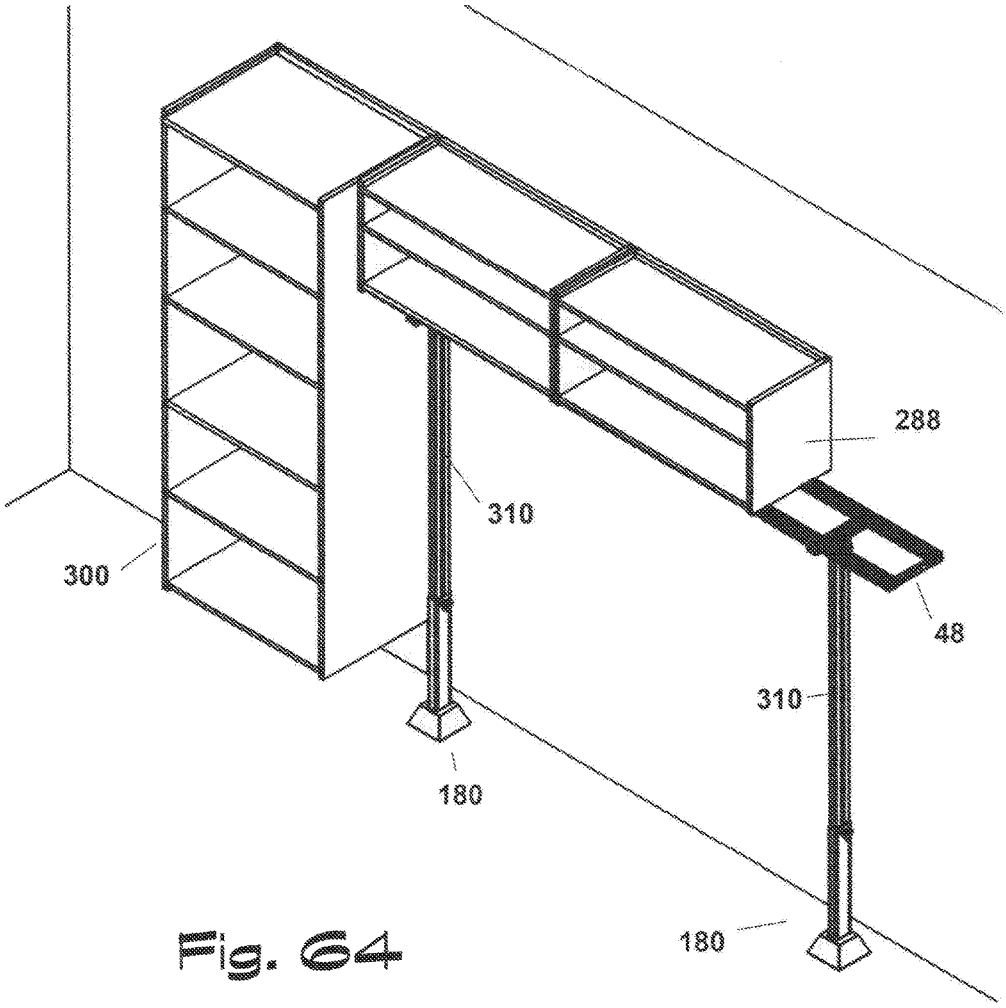
FIG. 64 is a perspective view of the system supporting a high hanging wall mount cabinet during mounting.

FIGS. 63 and 64 illustrate using components of the system to support wall cabinets during installation. This is normally a very difficult job for one person to do. Normally the cabinets are held in place by another person or support boards are attached to the wall at the proper height and the bottom of the cabinets rest on these boards. Even with this later approach, it is still difficult for one person to mount wall cabinets.

In recent years, it has become common practice to mount wall cabinets in garages and closets a short distance from the floor. FIG. 63 illustrates the configuration used to support wall cabinets in this manner. Two boards 302 are cut to match the width of the rail pair 48 and the desired height of the cabinet 300 above the floor. Boards 302 are attached to the ends of a rail pair 48 through holes in the endplates. These holes are shown in FIGS. 1, 4, and 5. This approach also insures that the cabinet 300 will be perpendicular to the floor when mounted. With cabinet 300 supported in this manner, the installer can easily position the cabinet 300 along the length of the wall before fastening it to the wall.

FIG. 64 shows a common situation associated with wall cabinets that are mounted far above the floor such as high cabinets over a workbench. The tall cabinet 300 has been mounted off the floor as illustrated in FIG. 63. Now the high cabinet 288 needs to be attached the cabinet 300 as well as to the wall. Two single leg stands 180 support the rail pair 48 which in turn supports the cabinet 288. The long leg extrusions 310 have replaced the standard length leg extrusions 54 of FIGS. 7 and 9 in order to reach the required height. With cabinet 288 totally supported by the rail pair 48, the installer can easily move cabinet 288 to attach it to cabinet 300 before attaching it to the wall. Because of the height of cabinet 288, the installer will need to use a ladder, step stool, or scaffold to reach the mounting points. With the cabinet 288 securely supported, this task becomes far easier for one person to do.

While at least one exemplary embodiment has been-presented in the foregoing detailed description, it should be appreciated that a vast number of variations exist. It should also be appreciated that the exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

The invention claimed is:

1. A modular workbench comprising:

at least one rail assembly, wherein each rail assembly comprises:

first and second elongated rails, each rail having a square cross-section; first and second end plates secured at opposite ends of the first and second elongated rails, at least one of the end plates having a projection engaging the elongated rails to prevent rotation about a longitudinal axis thereof;

wherein the first and second elongated rails are arranged in a spaced-apart and parallel relationship wherein each of the first and second rails comprises an extrusion having four faces, wherein each of the four faces has a slot formed therein; and a leg stand having a horizontal member supporting at least one rail assembly, wherein the rail assembly is secured to the horizontal member to form a generally flat, open-framed work surface.

2. The workbench of claim 1, further comprising a plurality of rail assemblies secured to the horizontal member of the leg stand to form the generally flat, openframed work surface.

3. The workbench of claim 2, wherein the plurality of rail assemblies are relatively positionable in a lateral direction along the length of the horizontal member for adjusting a width of the work surface.

4. The workbench of claim 2, wherein the plurality of rail assemblies are relatively positionable in a perpendicular direction relative to the horizontal member for adjusting a length of the work surface.

5. The workbench of claim 1, wherein the leg stand comprises a pair of vertical members extending from the horizontal member, each vertical member having a base, a first leg member extending from the base, a second leg member received in the first leg member and slidably positionable for adjusting the height of the leg stand, and a fastener extending between the first and second leg member for fixing the height of the leg stand.

6. The workbench of claim 5, further comprising a vertical scale attached to each second leg member for determining the length of the vertical member.

7. The workbench of claim 1, further comprising a horizontal scale attached to the horizontal member, wherein the horizontal scale is positionable along the horizontal member.

8. The workbench of claim 1, further comprising a locator supported on the horizontal member of the leg stand, wherein the horizontal member has a slot formed therein for receiving a fastener to releasably secure the locator to the horizontal member.

9. The workbench of claim 1, wherein each endplate comprise a body having a hole formed at each end for receiving a fastener to secure the endplate to the elongated rails, and a flange extending from the body between the ends, wherein the flange defines the projection.

10. The workbench of claim 9, wherein each of the first and second rails includes a slot formed in a face thereof, and each body includes a relief formed in each end and aligned with the slot for inserting a fastener into the slot from an end of the rails.

11. The workbench of claim 1, further comprising a bracket releasably secured to the work surface, wherein the bracket includes a power tool mount configured to secure a power tool to work surface between a pair of adjacent elongated rails.

12. The workbench of claim 11, wherein the bracket is releasably secured to adjacent rail assemblies.

13. The workbench of claim 1, wherein the leg stand comprises a first leg having a first horizontal member, a second leg having a second horizontal member, and an X-shaped brace extending between the first and second leg for positioning the first and second horizontal members in a spaced-apart parallel relationship.

14. The workbench of claim 1, further comprising a solid surface releasably secured to at least one of the first and second elongated rails and at least partially covering the rail assembly.

15. The workbench of claim 1, wherein at least one of the first and second elongated rails has a first slot formed in a first face of the rail and a second slot formed in a second face of the rail, and the workbench further comprises a panel clamping system including:

a plate rigidly mounted to the first face with a first fastener extending into the first slot; and an adjustable clamp mounted to the second face with a second fastener extending into the second slot, the adjustable clamp having a clamping element and a actuator configured to adjust a clamping pressure between the plate and the clamping element.

16. A modular workbench assembly comprising:

a plurality of rail assemblies, wherein each rail assembly comprises:

first and second elongated rails, each rail comprising an extrusion having a square cross-section with four faces, each face having a slot formed therein;

first and second end plates secured at opposite ends of the first and second elongated rails, each endplate comprising a body having a hole formed at each end for receiving a fastener to secure the endplate to the elongated rails, a flange extending from the body between the ends to define a projection engaging the elongated rails to prevent rotation about a longitudinal axis of the rails; wherein the first and second elongated rails are arranged in a spaced-apart and parallel relationship; and a leg stand including a first leg having a first horizontal member, a second leg having a second horizontal member, and an X-shaped brace extending between the first and second legs for positioning the first and second horizontal members in a spaced-apart parallel relationship, wherein the plurality of rail assemblies are secured to the horizontal members to form a generally flat, open-framed work surface.

17. The workbench assembly of claim 16, wherein each leg comprises a pair of vertical members extending from the horizontal member, each vertical member having a base, a first leg member extending from the base, a second leg member received in the first leg member and slidably positionable for adjusting the height of the leg stand, and a fastener extending between the first and second leg member for fixing the height of the leg stand.

18. The workbench of claim 16, wherein the plurality of rail assemblies are relatively positionable in a lateral direction along the length of the horizontal member for adjusting a width of the work surface and in a perpendicular direction relative to the horizontal member for adjusting a length of the work surface.

19. A power tool stand comprising a modular workbench according to claim 1, a structure to support a power tool in a fixed horizontal plane, and a rail pair locator member rigidly attached to the power tool support structure, wherein the rail pair locator includes a support surface configured to constrain the top surface of the rail pairs in a plane parallel to the fixed horizontal plane of the power tool.

20. A power tool stand comprising a modular workbench according to claim 1, a structure to support the power tool in a fixed horizontal plane, and a brace member, rigidly attached to the power tool support structure, wherein the brace member is configured to locate and constrain the leg stand relative to the power tool support structure.

* * * * *